US007314377B2

(12) United States Patent
Northey et al.

(10) Patent No.: US 7,314,377 B2
(45) Date of Patent: Jan. 1, 2008

(54) ELECTRICAL POWER CONNECTOR

(75) Inventors: William A. Northey, Etters, PA (US); John B. Brown, III, Mechanicsburg, PA (US); Stephen L. Clark, Dillsburg, PA (US); Joseph L. Ortega, Campbell, CA (US); Joseph B. Shuey, Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/973,774

(22) Filed: Oct. 26, 2004
(Under 37 CFR 1.47)

(65) Prior Publication Data

US 2006/0166536 A1 Jul. 27, 2006

Related U.S. Application Data

(63) Continuation-in-part of application No. 09/886,432, filed on Jun. 21, 2001, now Pat. No. 6,869,294, which is a continuation of application No. 09/160,900, filed on Sep. 25, 1998, now Pat. No. 6,319,075.

(60) Provisional application No. 60/082,091, filed on Apr. 17, 1998.

(51) Int. Cl.
*H01R 9/09* (2006.01)

(52) U.S. Cl. ..... 439/79; 439/825

(58) Field of Classification Search ..... 439/825, 439/79, 826, 827, 692, 947
See application file for complete search history.

(56) References Cited

U.S. PATENT DOCUMENTS

| | | | | |
|---|---|---|---|---|
| 3,497,850 | A | 2/1970 | Gallo, Sr. | 337/197 |
| 3,750,092 | A | 7/1973 | Bury | 339/192 RL |
| 3,789,348 | A | 1/1974 | Lenaerts et al. | 339/198 R |
| 3,910,671 | A | 10/1975 | Townsend | 339/97 R |
| 3,944,312 | A | 3/1976 | Koenig | 339/59 R |
| 4,005,923 | A | 2/1977 | Davis, Jr. | 339/157 |
| 4,073,564 | A | 2/1978 | Davis, Jr. | 339/157 |
| 4,227,762 | A | 10/1980 | Scheiner | 339/91 R |
| 4,500,160 | A | 2/1985 | Bertsch | 339/166 |
| 4,626,637 | A | 12/1986 | Olsson et al. | 200/284 |
| 4,632,475 | A * | 12/1986 | Tomita | 439/1 |
| 4,659,158 | A | 4/1987 | Sakamoto et al. | 339/19 |
| 4,669,801 | A | 6/1987 | Worth | 439/404 |
| 4,685,886 | A | 8/1987 | Denlinger et al. | 439/55 |
| 4,709,976 | A | 12/1987 | Nakama et al. | 439/350 |
| 4,780,088 | A | 10/1988 | Means | 439/107 |

(Continued)

FOREIGN PATENT DOCUMENTS

| | | |
|---|---|---|
| DE | 23 50 834 | 4/1975 |

(Continued)

*Primary Examiner*—Hien Vu
(74) *Attorney, Agent, or Firm*—Woodcock Washburn LLP

(57) ABSTRACT

A pair of mating connectors includes a receptacle having an insulative housing and at least one conductive receptacle contact with a pair of spaced walls forming a plug contact receiving space. The plug connector has an insulative housing and at least one conductive contact having a projection engageable in the plug receiving space of the receptacle contact. The open structure of both the receptacle and plug contacts enhances heat dissipation and allows flexibility in achieving desired contact normal forces. The contact construction is especially useful for electronic power connectors.

10 Claims, 24 Drawing Sheets

U.S. PATENT DOCUMENTS 4,790,763 A * 12/1988 Weber et al. ..... 439/65
4,790,764 A 12/1988 Kawaguchi et al. ..... 439/78
4,820,175 A 4/1989 Hasegawa et al. ..... 439/98
4,838,809 A 6/1989 Mouissie ..... 439/155
4,845,592 A 7/1989 Himes, Jr. et al. ..... 361/407
4,875,865 A 10/1989 Demler, Jr. et al. ..... 439/101
4,881,905 A 11/1989 Demler, Jr. et al. ..... 439/79
4,900,271 A 2/1990 Colleran et al. ..... 439/595
4,917,625 A 4/1990 Haile ..... 439/358
4,941,830 A 7/1990 Tkazyik et al. ..... 439/59
4,950,186 A 8/1990 Kaley et al. ..... 439/882
4,954,090 A 9/1990 Shimochi ..... 439/76
4,968,263 A 11/1990 Silbernagel et al. ..... 439/246
5,046,960 A 9/1991 Fedder ..... 439/108
5,107,328 A 4/1992 Kinsman ..... 357/74
5,108,301 A 4/1992 Torok ..... 439/263
5,139,426 A 8/1992 Barkus ..... 439/65
5,152,700 A 10/1992 Boguresky et al. ..... 439/733
5,158,471 A 10/1992 Fedder et al. ..... 439/80
5,207,591 A 5/1993 Ozaki et al. ..... 439/212
5,281,168 A 1/1994 Krehbiel et al. ..... 439/595
5,295,843 A * 3/1994 Davis et al. ..... 439/108
5,358,422 A 10/1994 Schaffer et al. ..... 439/346
5,362,249 A 11/1994 Carter ..... 439/357
5,376,012 A 12/1994 Clark et al. ..... 439/80
5,403,206 A 4/1995 McNamara et al. ..... 439/608
5,435,876 A 7/1995 Alfaro et al. ..... 156/247
5,549,480 A 8/1996 Cheng ..... 439/79
5,551,883 A 9/1996 Davis ..... 439/65
5,582,519 A 12/1996 Buchter ..... 439/101
5,590,463 A 1/1997 Feldman et al. ..... 29/844
5,605,489 A 2/1997 Gale et al. ..... 451/28
5,618,187 A 4/1997 Goto ..... 439/79
5,622,511 A 4/1997 Jarrett ..... 439/248
5,643,013 A 7/1997 Weidler et al. ..... 439/660
5,667,392 A 9/1997 Kocher et al. ..... 439/79
5,674,078 A 10/1997 Davis et al. ..... 439/79
5,716,234 A 2/1998 Phillips ..... 439/595
5,727,961 A 3/1998 Landis et al. ..... 439/287
5,785,557 A 7/1998 Clark et al. ..... 439/600
5,865,651 A 2/1999 Dague et al. ..... 439/680
5,872,046 A 2/1999 Kaeriyama et al. ..... 438/465
5,904,594 A 5/1999 Longueville et al. ..... 439/608
5,923,995 A 7/1999 Kao et al. ..... 438/460
5,924,899 A 7/1999 Paagman ..... 439/701
5,937,140 A 8/1999 Leonard et al. ..... 392/392
6,027,360 A 2/2000 Jenkins ..... 439/364
6,062,911 A 5/2000 Davis et al. ..... 439/630
6,063,696 A 5/2000 Brenner et al. ..... 438/465
6,178,106 B1 1/2001 Umemoto et al. ..... 363/146
6,190,215 B1 2/2001 Pendleton et al. ..... 439/853
6,319,075 B1 11/2001 Clark et al. ..... 439/825
6,335,224 B1 1/2002 Peterson et al. ..... 438/114
6,358,094 B1 3/2002 Belopolsky et al. ..... 439/637
6,394,818 B1 5/2002 Smalley, Jr. ..... 439/79
6,402,566 B1 6/2002 Middlehurst et al. .... 439/699.1
6,471,523 B1 10/2002 Shuey ..... 439/63
6,644,980 B2 11/2003 Kameda ..... 439/65
6,692,316 B2 2/2004 Hsieh et al. ..... 438/845
6,733,301 B2 5/2004 Brown, III ..... 439/65

FOREIGN PATENT DOCUMENTS

DE 34 41 416 A1 5/1986
DE 40 01 104 A1 7/1991
EP 2 168 550 6/1986
EP 0 465 013 1/1992
EP 0 724 313 7/1996
EP 0 951 102 A2 10/1999
FR 2 699 744 6/1994
JP 09/055 245 2/1997

* cited by examiner

ELECTRICAL POWER CONNECTOR

CROSS REFERENCE TO RELATED APPLICATIONS

This application is a continuation-in-part of U.S. patent application Ser. No. 09/886,432, filed Jun. 21, 2001, now U.S. Pat. No. 6,869,294, which is a continuation of U.S. patent application Ser. No. 09/160,900, filed Sep. 25, 1998, which is now U.S. Pat. No. 6,319,075, and which claims the benefit of United States Provisional Patent Application Ser. No. 60/082,091, filed Apr. 17, 1998; the contents of all of which are incorporated by reference herein.

FIELD OF THE INVENTION

The present invention relates to electrical connectors and more particularly to electronic power connectors especially, useful in circuit board or backplane interconnection systems.

BACKGROUND OF THE INVENTION

Designers of electronic circuits generally are concerned with two basic circuit portions, the logic or signal portion and the power portion. In designing logic circuits, the designer usually does not have to take into account any changes in electrical properties, such as resistance of circuit components, that are brought about by changes in conditions, such as temperature, because current flows in logic circuits are usually relatively low. However, power circuits can undergo changes in electrical properties because of the relatively high current flows, for example, on the order of 30 amps or more in certain electronic equipment. Consequently, connectors designed for use in power circuits must be capable of dissipating heat (generated primarily as a result of the Joule effect) so that changes in circuit characteristics as a result of changing current flow are minimized. Conventional plug contacts in circuit board electrical power connectors are generally of rectangular (blade-like) or circular (pin-like) cross-section. These are so-called "singular-mass" designs. In these conventional singular-mass blade and pin configurations, the opposing receptacle contacts comprise a pair of inwardly urged cantilever beams and the mating blade or pin is located between the pair of beams. Such arrangements are difficult to reduce in size without adversely effecting heat dissipation capabilities. They also provide only minimal flexibility to change contact normal forces by adjustment of contact geometry.

There is a need for a small contact which efficiently dissipates heat and which has readily modifiable contact normal forces.

SUMMARY OF THE INVENTION

The present invention relates to electrical connectors that comprises a receptacle having an insulative housing and at least one conductive receptacle contact comprising a pair of spaced walls forming a plug contact receiving space. A mating plug comprises an insulative housing and at least one conductive contact having a pair of spaced walls which form a projection engageable in the plug receiving space of the receptacle contact. The contacts employ a "dual mass" principle that provides a greater surface area available for heat dissipation, principally by convection, as compared with "single-mass" contacts. This arrangement provides an air flow path through spaced portions of the contacts of the plug and receptacle connectors when mated.

BRIEF DESCRIPTION OF THE DRAWINGS

The present invention is further described with reference to the accompanying drawings in which.

DETAILED DESCRIPTION OF ILLUSTRATIVE EMBODIMENTS

Figure 1:
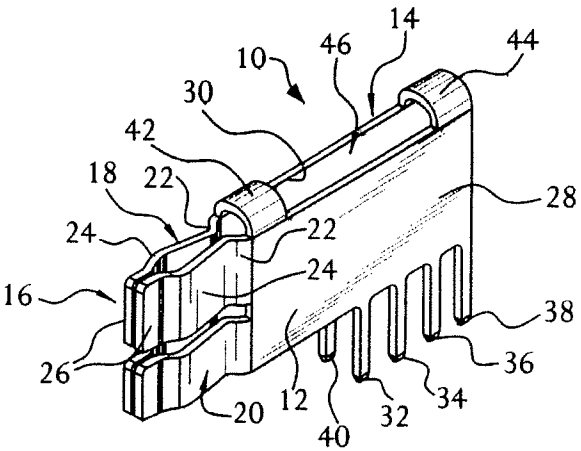
FIG. 1 is a perspective view of a plug contact.
Figure 2:
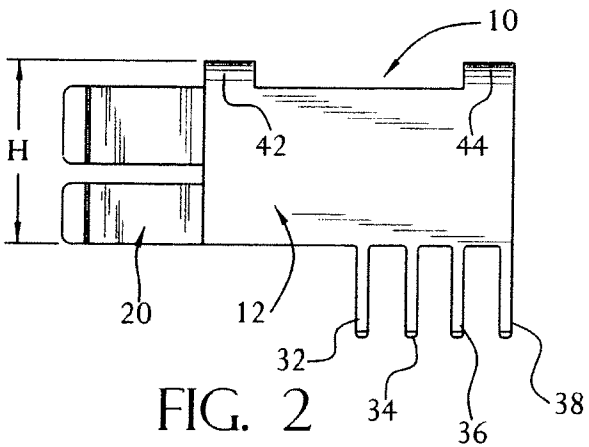
FIG. 2 is a side elevational view of the plug contact shown in FIG. 1.

Referring to FIGS. 1 and 2, a plug contact 10 for use in a plug connector is shown. This plug contact has two opposed major side walls 12 and 14. A front projection, identified generally by numeral 16, has an upper section 18 and a lower section 20. Each of these upper and lower sections comprises a pair of opposed cantilever beams, each beam having inwardly converging proximal section 22, arcuate contact section 24 and a distal section 26. The opposed distal sections 26 are preferably parallel to each other. The distal sections can be positioned slightly apart when the beams are in relaxed condition, but come together when the beams are deflected as the front projection is inserted into a receptacle contact (as explained below). This provides over-stress protection for the beams during mating. The side walls also include planar panels 28 and 30. Terminals 32, 34, 36 and 38 extend from an edge of panel 28. Terminal 40 extends from panel 30, along with a plurality of like terminals (not shown). Terminals 32-40 can comprise through hole, solder-to-board pins (as shown), press fit pins or surface mount tails. The panels 28 and 30 are connected by upper arcuate bridging elements 42 and 44. A medial space 46, adapted for air flow, is defined between the panels 28 and 30. The contact 10 is stamped or otherwise formed as a single piece from a strip of suitable contact materials such as phosphor bronze alloys or beryllium copper alloys.

Figure 3:
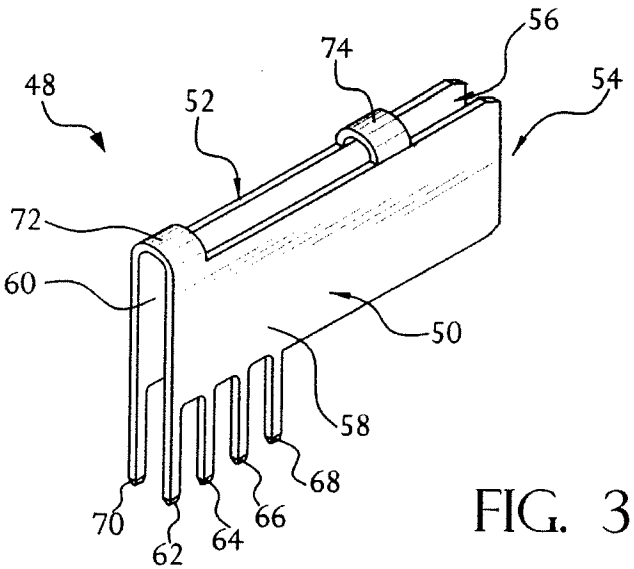
FIG. 3 is a perspective view of a receptacle contact.
Figure 4:
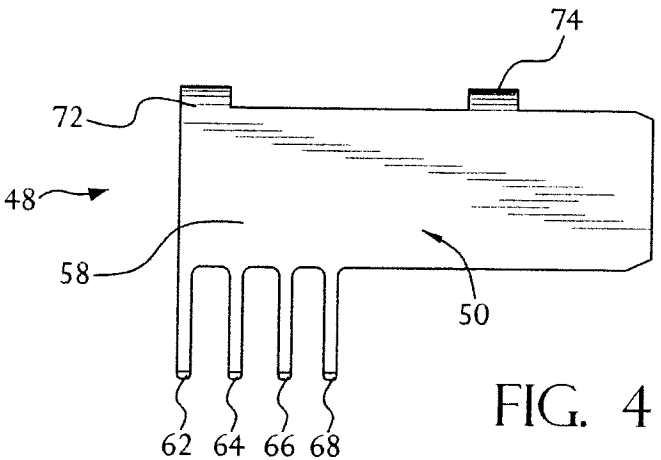
FIG. 4 is a side elevational view of the receptacle contact shown in FIG. 3.
Figure 7:
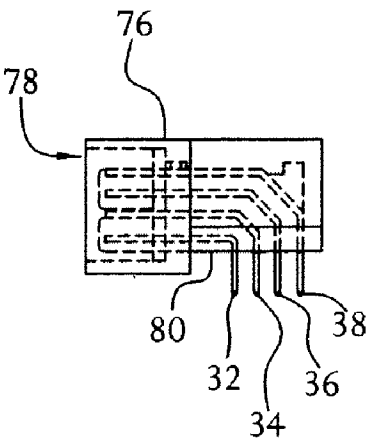
FIG. 7 is an end view of the plug connector shown in FIG. 5.
Figure 5:
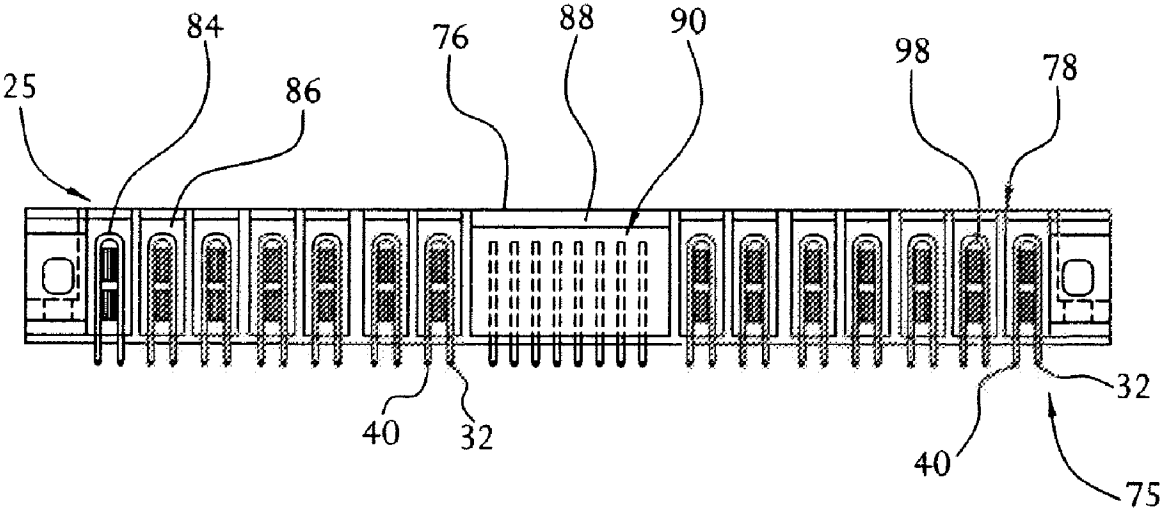
FIG. 5 is a front elevational view of a plug connector.
Figure 6:
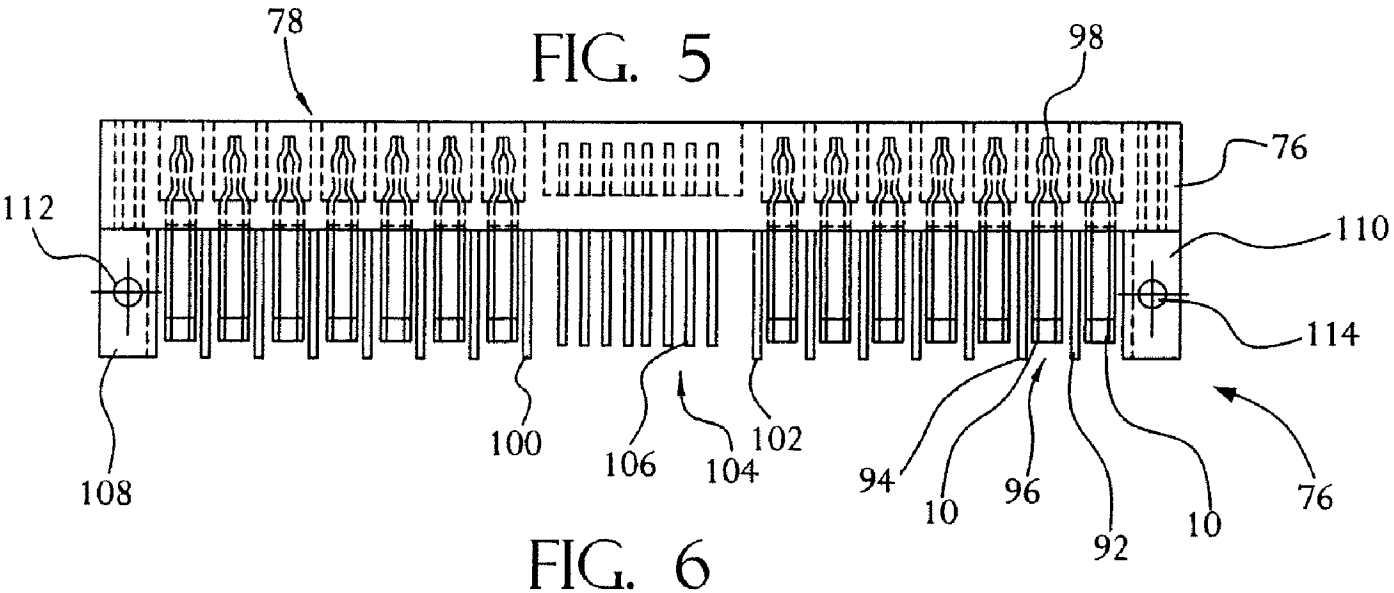
FIG. 6 is a top plan view of the plug connector shown in FIG. 5.

Referring to FIGS. 3 and 4, receptacle contact 48 is shown. This receptacle contact has opposed, preferably planar and parallel side walls 50 and 52. These walls extend forwardly in a front projecting portion 54, that forms a medial plug receiving space 56. The distance between walls 50 and 52 at portion 54 is such that the projection 16 of the plug contact 10 is receivable in the plug contact receiving space 56, with the beams being resiliently deflected toward the center plane of contact 10. The deflection causes the beams to develop outwardly directed forces, thereby pressing the arcuate portions 24 against the inside surfaces of the portions 54 forming the receiving space 56, to develop suitable contact normal force. The side walls 50 and 52 also include, respectively, panels 58 and 60. Extending from panel 58 there are terminals 62, 64, 66 and 68. Extending from panel 60 there is terminal 70 as well as several other terminals (not shown). These terminals are essentially the same as previously described terminals 32-40. The side walls 50 and 52 are joined together by generally arcuate bridging elements 72 and 74. Preferably, the receptacle contact is also stamped or otherwise formed in a single piece from a strip of phosphor bronze alloy or beryllium copper alloy.

FIGS. 5-9 illustrate a plug connector 75 having an insulative plug housing 76. The housing 76 includes a front side 78 having a plurality of power contact apertures 84 and 86. The front projection or mating portion 16 (FIGS. 1 and 2) of the plug contacts is disposed in apertures 84, 86. The plug contacts 10 are retained in the housing 76 by an interference fit between the contact and the housing. This is accomplished by having the dimension H (FIG. 2), the dimension between bottom edge of wall 12 and the top of bridging element 42, slightly greater than the dimension of the cavity in housing 76 that receives this portion of plug contact 10. The front side 78 may also include a signal pin array opening 88 for housing a signal pin array designated generally as numeral 90. The housing 76 also includes a number of rear vertical partitions, such as partitions 92 and 94, which form power contact retaining slots 96 for housing the plug contacts 98. The opposed medial vertical partitions 100 and 102 form between them a rear signal pin array space 104 for housing the rear portion 106 of the signal pins. The housing 76 also includes opposed rear mounting brackets 108 and 110 which have respectively mounting apertures 112 and 114. The plug contacts 10 have terminals 32, 34, 36, 38 and 40 extending below a bottom edge 80 of housing 76. The edge 80 forms a mounting interface, along which the housing is mounted to a printed circuit board or other structure on which the connector is mounted.

Referring to FIGS. 10-14, a receptacle connector 128 is shown. Receptacle 128 has an insulative housing 129 with a front side 130 including a plurality of silos 131 having contact openings, such as openings 136 and 138. The front side 130 forms a mating interface of the connector 128 for mating with plug connector 75. The silos 131 are configured and sized to be received in openings 84, 86 of connector 75. The front portions 54 (FIGS. 3-4) of the receptacle contacts are disposed within silos 131 and openings 134, 136 are sized and configured to receive the upper and lower sections 18 an 20 of plug contacts 10. The front side 130 has a signal pin receiving area 140 with signal pin receiving apertures. The housing 129 also has a plurality of rear partitions, such as partitions 144 and 146, which form contact retaining slots 148 for housing receptacle contacts 48. Signal pin housing 152 receives a signal receptacle contact array 154. The housing 129 also includes opposed rear mounting brackets 156 and 158 which have, respectively, mounting apertures 160 and 162. The receptacle contact terminals 62, 64, 66, 68 and 70 extend beneath surface 137, that forms the mounting interface of receptacle connector 128. The front side 130 of the housing 128 also has a plurality of vertical spaces 176 and 178, disposed between silos 131.

The receptacle contacts 48 are retained in housing 129 by an interference fit in essentially the same manner as previously described with respect to plug contacts 10. Retaining the contacts in this fashion allows substantial portions of the walls 12, 14 of the plug contact and walls 58, 60 of the receptacle contact to be spaced from surrounding parts of the respective housings 76 and 129. This leaves a substantial proportion of the surface area of both contacts (including the plug contacts), exposed to air, thereby enhancing heat dissipation capabilities, principally through convection. Such enhanced heat dissipation capabilities are desirable for power contacts.

Figure 15:
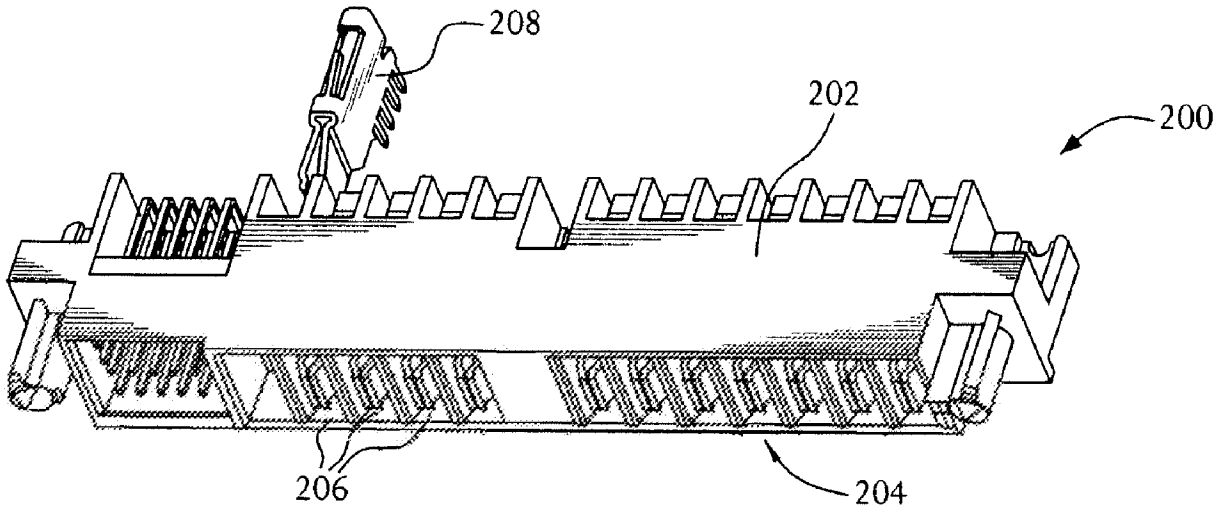
FIG. 15 is a front perspective view of a second embodiment of plug connector.

FIG. 15 shows another plug connector 200 embodying the invention. In this embodiment, the housing 202, preferably formed of a molded polymeric material, has a front face 204 that forms the mating interface of the connector. The face 204 includes a plurality of openings, such as openings 206, formed in a linear array.

Figure 16:
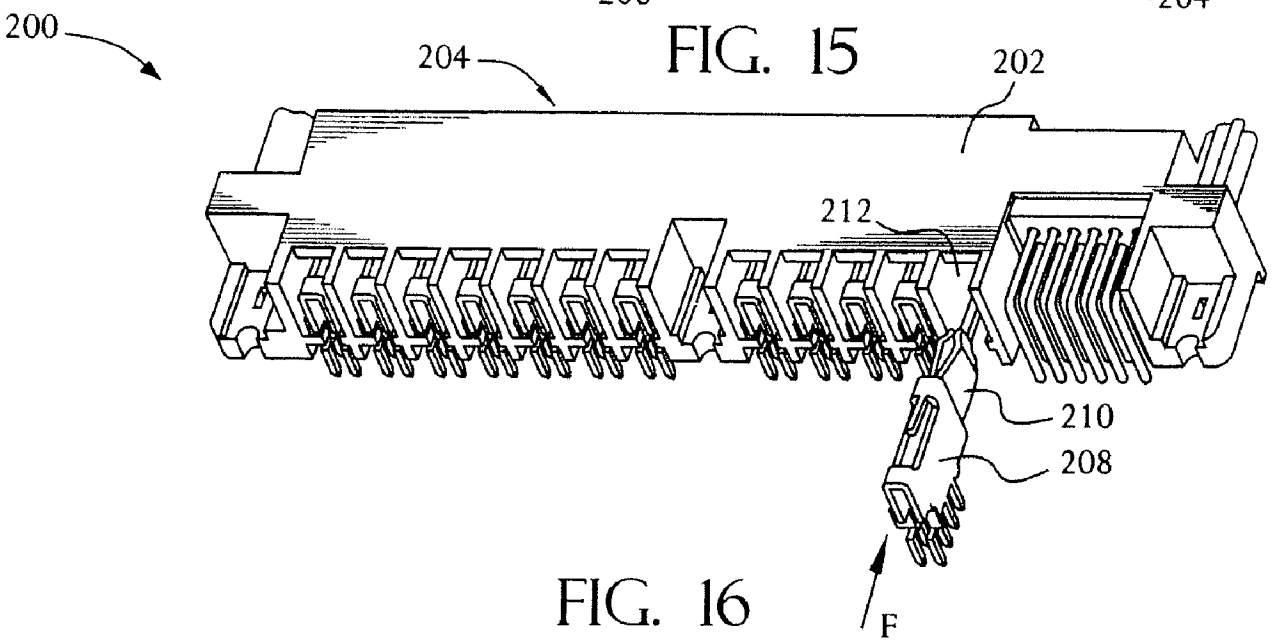
FIG. 16 is a rear perspective view of the plug connector of FIG. 15.

Referring to FIG. 16, the plug connector 200 includes a plurality of plug contacts 208. The contacts 208 are inserted from the rear of the housing into cavities 212 that extend from the rear of the housing toward the front of the housing. When the contacts 208 are fully inserted into the housing 202, the contact portions 210 with contacts 208 are disposed in the openings 206.

Figure 17:
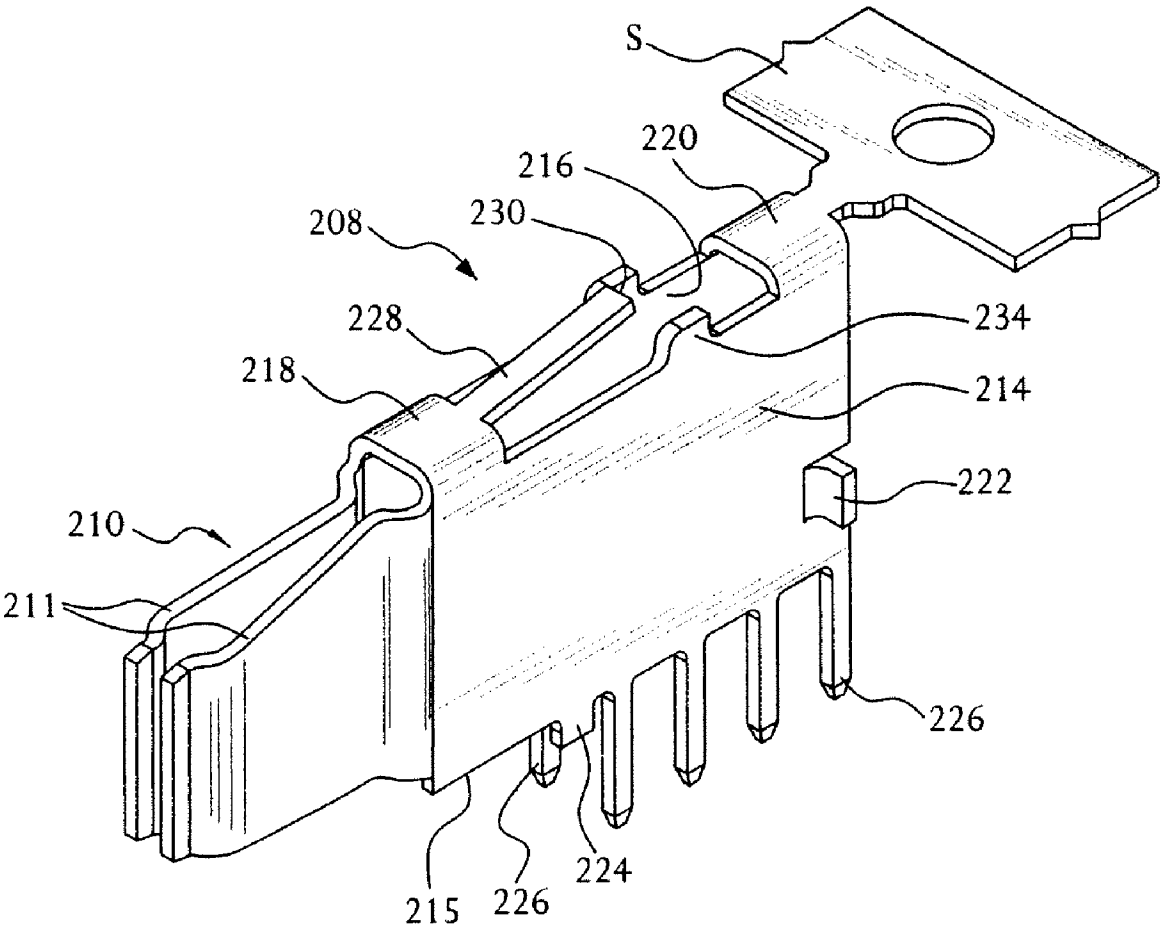
FIG. 17 is an isometric view of a plug contact used in the connector of FIG. 15, with the contact still attached to a portion of the strip material from which its formed.

Referring to FIG. 17, the plug contact 208 is similar in many respects to the plug contacts shown in FIG. 1. It includes spaced panel-like walls 214, 216 that preferably are planar and substantially parallel. The walls 214, 216 are joined by a front bridging element 218 and a rear bridging element 220. In this embodiment, the contact section 210 is formed by two opposed cantilevered beams 211 that extend from front edges of the walls 214, 216. Preferably, each wall includes a fixing tang 224 formed along a bottom of the edge of the wall. The walls 214, 216 also include lateral positioning elements, such as bent tangs 222, for centering the contact within cavities 212 in housing 202. Each wall also includes a positioning feature, such as raised lug 234.

The front bridging element 218 includes a rearwardly extending retention arm 228 that is cantilevered at its proximal end from the bridging element. Arm 228 includes a locating surface 230 at its distal end.

Terminals, such as through-hole pins 226, extend from the bottom edge of each wall 214, 216. The terminals 226 can be solder-to-board pins (as shown) or can comprise press fit or other types of terminals.

As can be seen from FIG. 17, the contacts 208 can be formed from sheet stock by stamping and forming the part from a strip of metrallic stock suitable for forming electrical contacts. The contacts 208 can be retained on a carrier strip S for gang insertion or separated from the strip prior to insertion into a housing.

Figure 18:
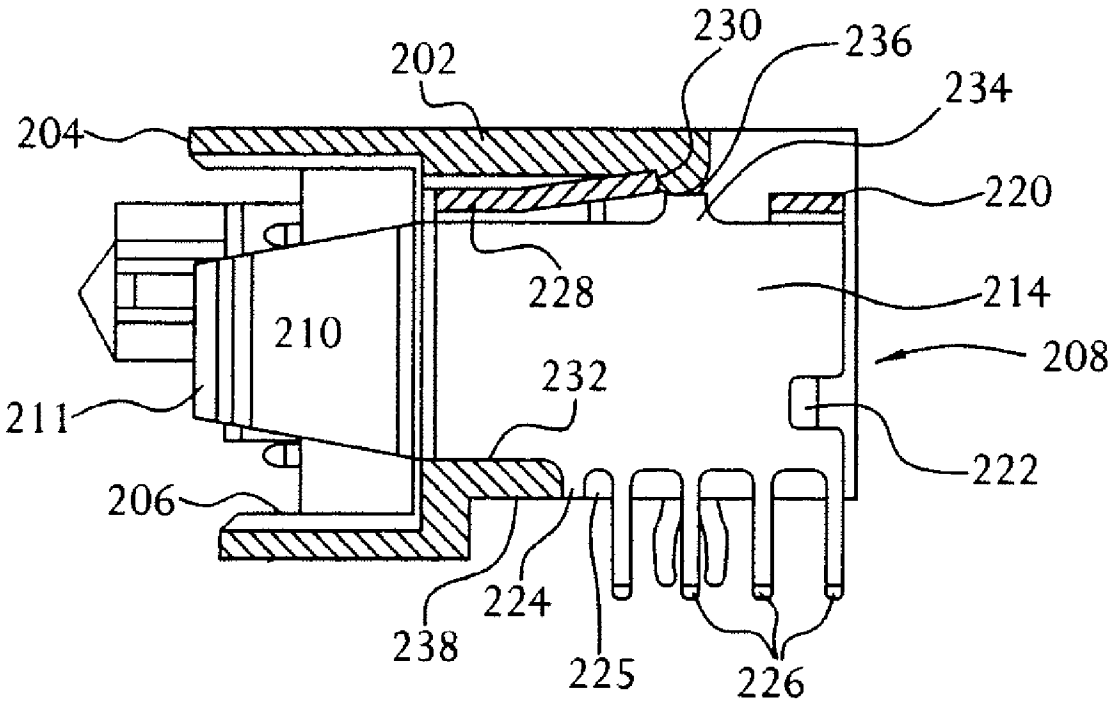
FIG. 18 is a side cross-sectional view of the plug connector of FIG. 15.

Referring to FIG. 18, the contact 208 is inserted into housing 202 from the rear into cavities 212 (FIG. 16). The contact 208 is located (in the vertical sense of FIG. 18) by engagement of the bottom edge 215 (FIG. 17) against surface 232 of the housing and by engagement of the top edges of the lugs 234 with the rib 236 in the upper part of the housing. The contact is maintained centered within the cavity 212 by the lateral tangs 222 that engage side walls of the cavity 212. The contact 208 is longitudinally locked in the housing (in the direction of contact mating) by means of the spring arm 228 that is deflected downwardly by the rib 236 of the housing during insertion and then resiles upwardly to position the stop surface 230 at its distal end against or near the forward surface of the rib 236.

The downwardly extending tang 24 is preferably received in a slot 225 in the housing, the width of the slot being substantially the same as the thickness of the tang 224. By capturing the tang 224 in the slot 225, deformation of the wall section, as might occur when the cantilever arms 211 of the contact section are urged toward each other, is limited to the portion of the walls 212, 216 disposed forwardly of the tangs 224. This enhances control of the contact normal forces generated by deflection of the cantilever arms 211.

As shown in FIG. 18, the terminals 226 extend below the bottom surface 238 of the housing 202, which bottom surface defines a mounting interface of the connector, along which it is mounted on a printed circuit board.

Figure 19:
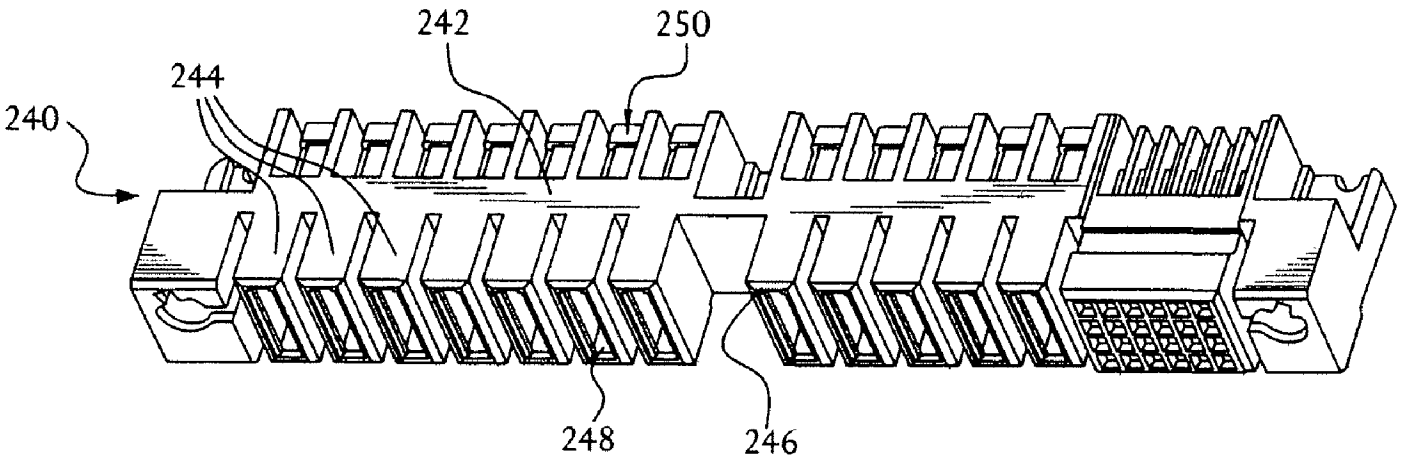
FIG. 19 is a front perspective view of a receptacle connector matable with the plug connector of FIG. 15.
Figure 20:
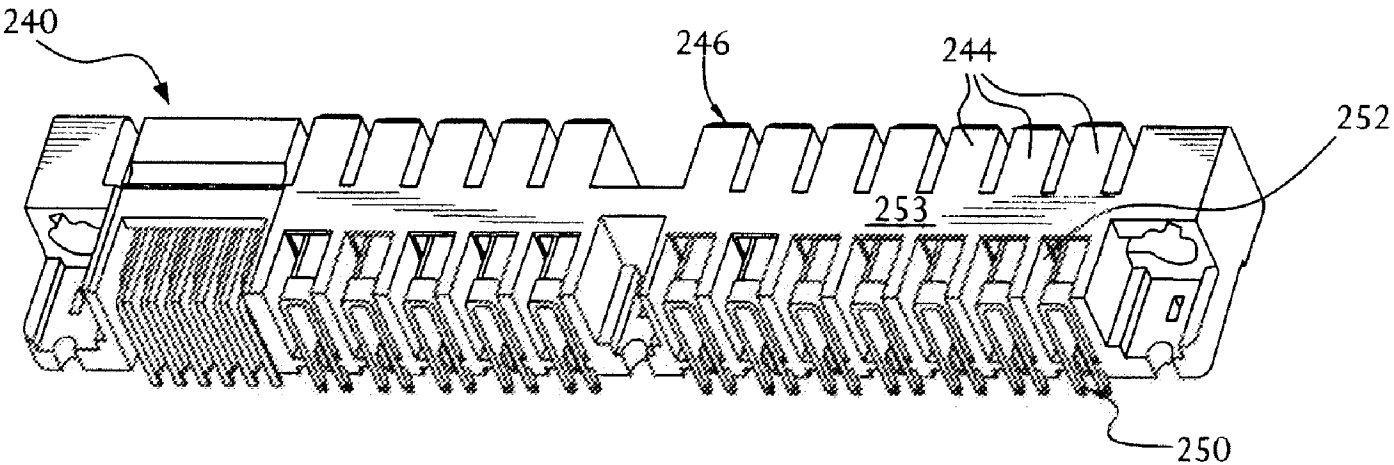
FIG. 20 is a rear perspective view of the receptacle connector shown in FIG. 19.

FIGS. 19 and 20 show a receptacle connector for mating with the plug connector illustrated in FIGS. 15-18. The receptacle connectors 240 include an insulative housing 242 that comprises an array of receptacle silos 244. The front surfaces 246 of the silos are substantially coplanar and form a mating interface of the connector. Each silo has an opening 248 for receiving the contact section 210 of the plug contacts 208 of the mating connector. The plurality of receptacle contacts 250 are mounted in the housing 242, preferably by insertion from the rear into cavities 252. As shown in FIG. 20, preferably the top wall 254 of the housing does not extend fully to the rear of the connector housing, thereby leaving substantial openings in the cavities 252.

Figure 21:
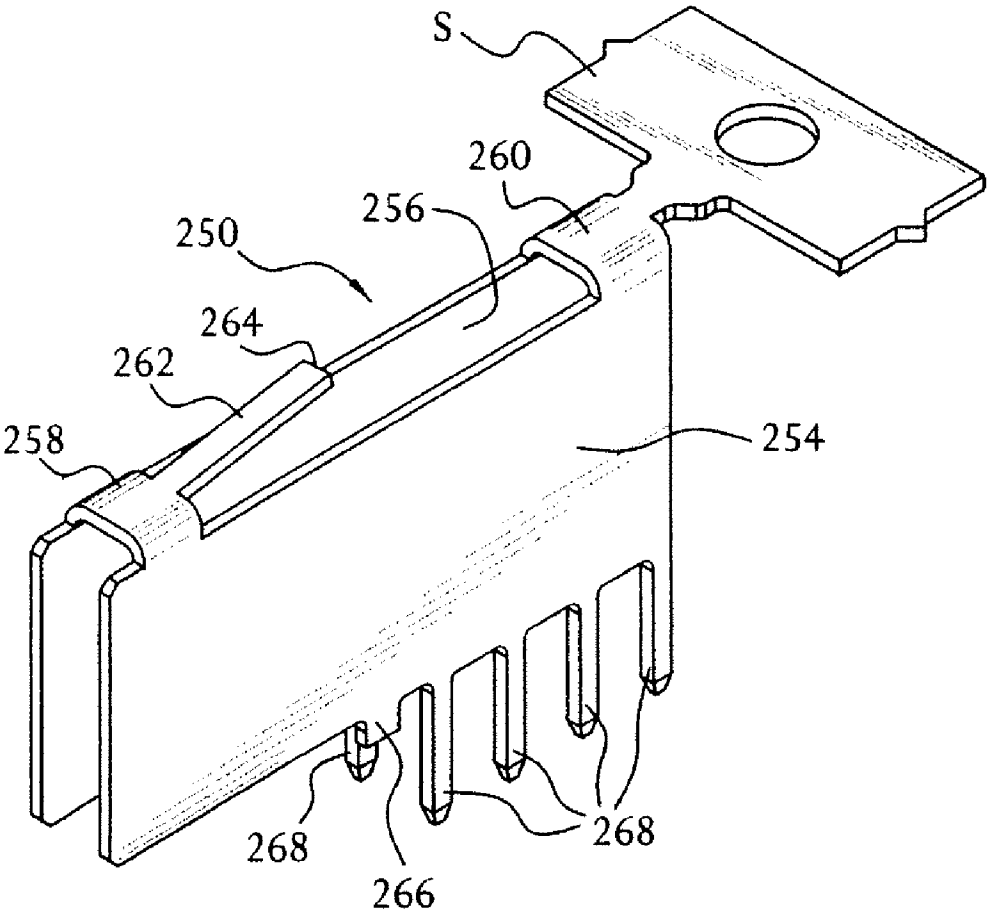
FIG. 21 is a isometric view of a receptacle contact used in the connector shown in FIG. 19, with the contact still attached to a portion of the metal strip from which it was formed.

The receptacle contact for receptacle connector 240 is illustrated in FIG. 21. The contact 250 is similar in basic form to the receptacle contact 48 illustrated in FIGS. 3 and 4. It includes two opposed walls 254, 256 that are preferably substantially planar and parallel, thereby forming between them a contact receiving and air flow space. The walls 254, 256 are joined by a front bridging element 258 and a rear bridging element 260. The front bridging element 258 includes a resilient latching arm that is cantilevered at its proximal end from bridging element 258 and carries at its distal end the latching or locking surface 264. As described previously, the receptacle contact 250 can be formed in a single, unitary piece, by stamping and forming the contact from a strip. As mentioned previously, the contacts can be inserted into the housing while attached to carrier strip S or after being separated therefrom.

Figure 22:
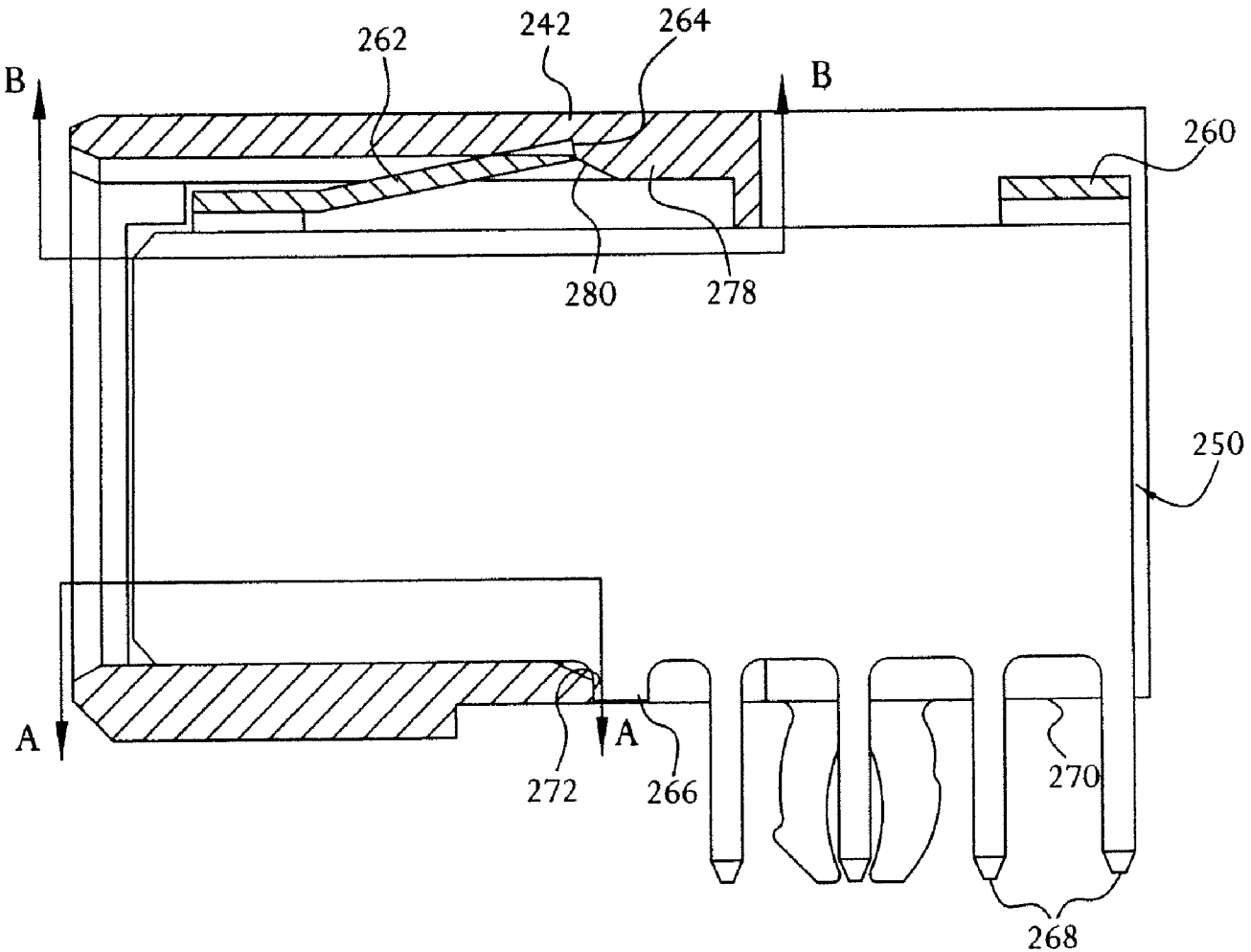
FIG. 22 is a side cross-sectional view of the receptacle connector shown in FIG. 19.

FIG. 22 is cross-sectional view showing a receptacle contact 250 inserted into housing 242. As shown, the locating tang 266 is positioned with its forward surface against the locating surface 272 in the bottom wall of the housing 242, thereby positioning the contact in its forward-most position. As the contact is inserted in the housing, the latching arm 262 is caused to resile downwardly when it engages the latching portion 278 of the housing. As the latching arm 262 resiles upwardly after it passes the latching section 278, the locking surface 264 engages a raised rib 280 (FIG. 22*b*) thereby locking the contact against rearward movement with respect to the housing. The terminals 268 extend beyond the surface 270 that forms the mounting interface of connector 240.

Figure 22A:
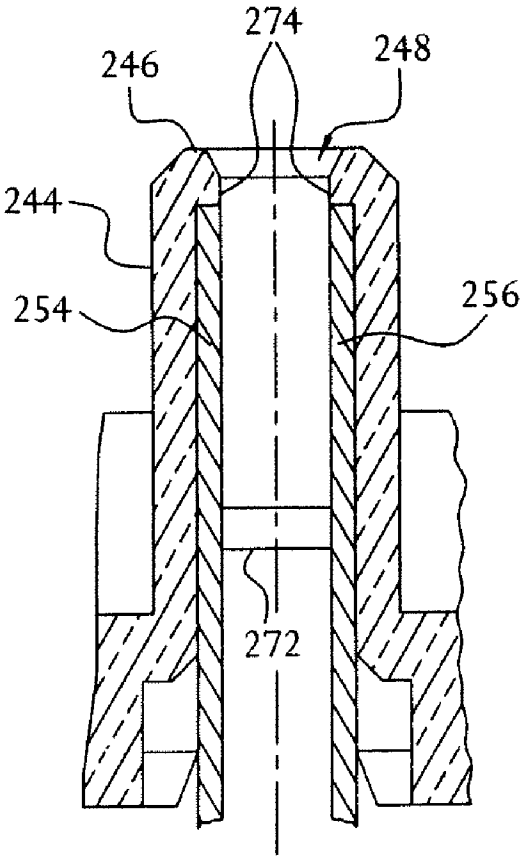
FIG. 22*a* is a partial cross-sectional view taken along line AA of FIG. 22.
Figure 22B:
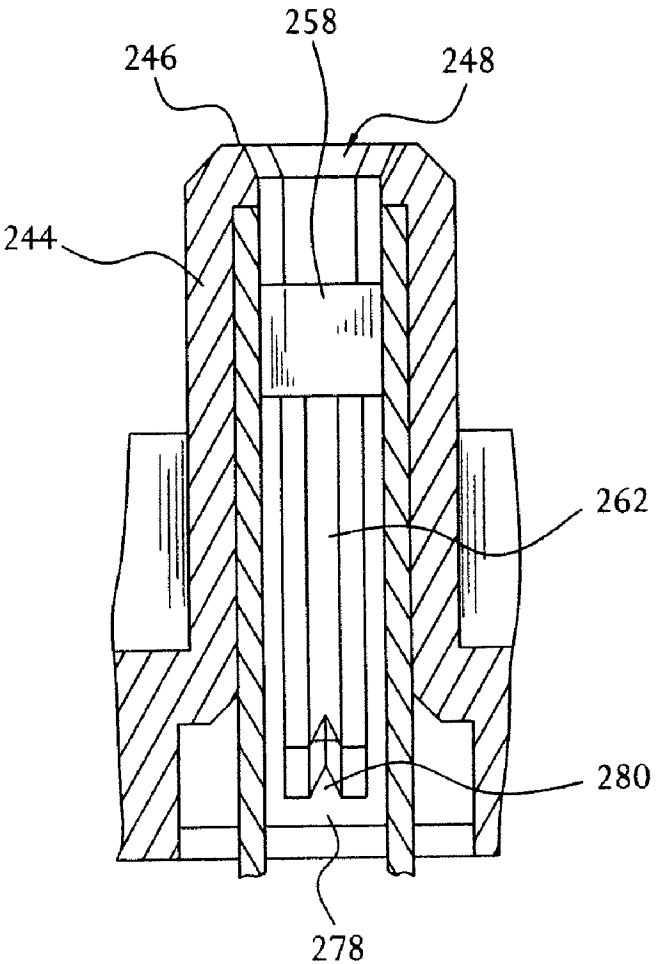
FIG. 22*b* is a partial cross-sectional view taken along line BB of FIG. 22.

As illustrated in FIGS. 22*a* and 22*b*, the forward portions of the walls 254, 256 are disposed along inside side walls of the silos 44. At the forward surface 246 of each silo, a plug contact receiving opening 248 is formed. The opening includes a pair of lips 274 that are coplanar with or extend just slightly beyond the inside surfaces of the walls 254, 256. This arrangement provides the benefit of lowered initial insertion forces when the connectors 200 and 240 are mated. As the silos 244 enter the openings 206 (FIG. 15), the contact sections 210 formed by the cantilevered arms 211 first engage the surfaces of lips 274. Because the coefficient of friction between the cantilevered arms 22 and the plastic lips 274 is relatively lower than the coefficient friction between the cantilevered arms and the metal walls 254,256, initial insertion force is minimized.

Figure 23:
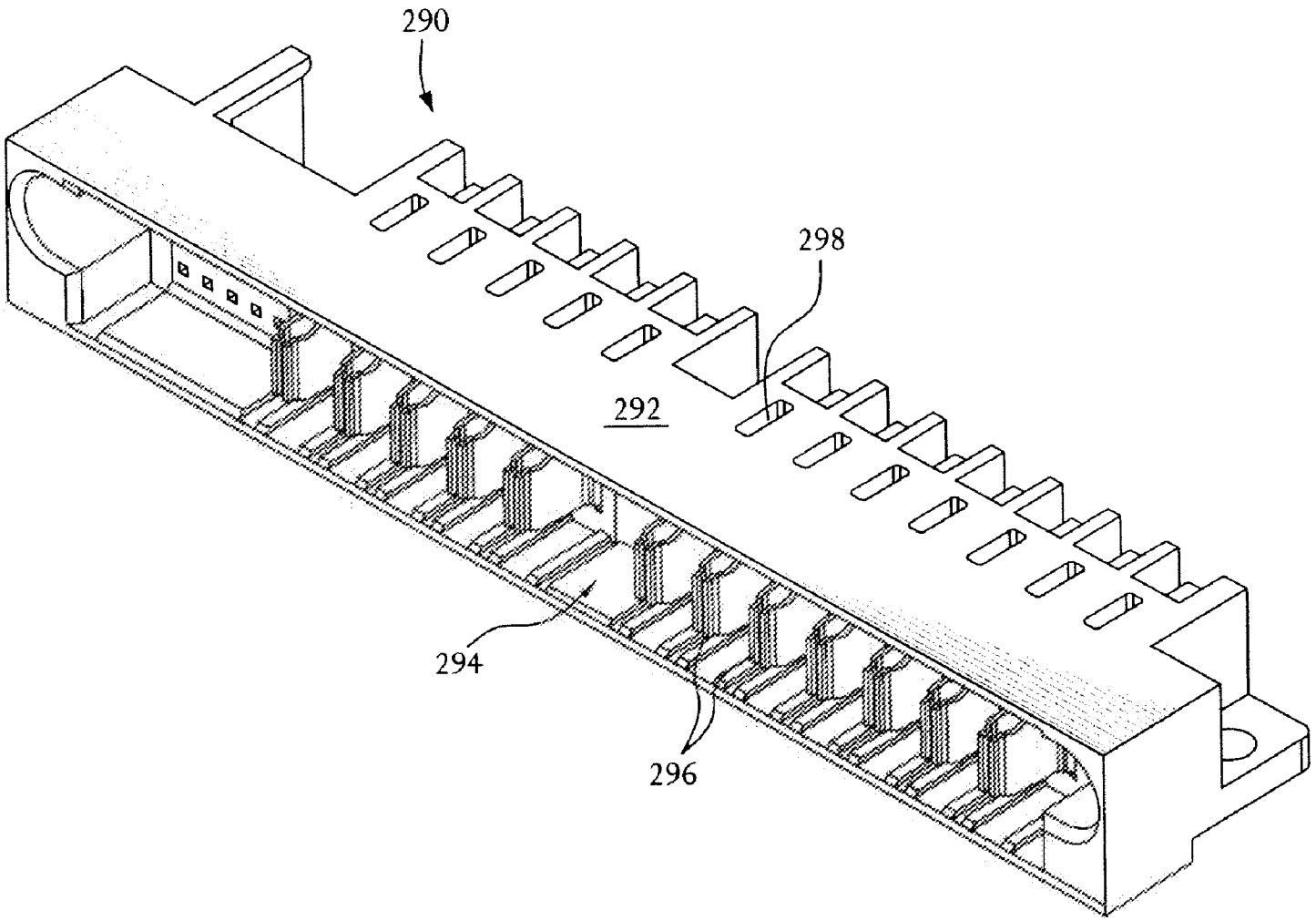
FIG. 23 is a front perspective view of a third embodiment of plug connector.
Figure 23A:
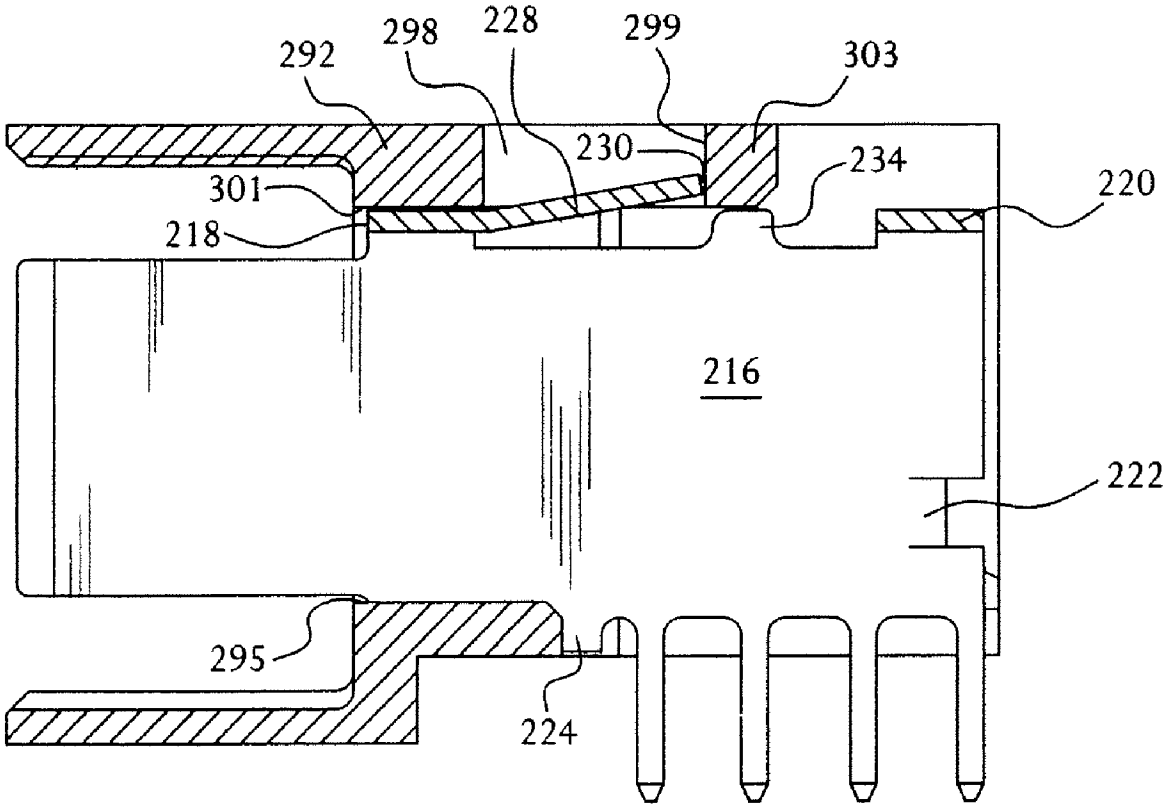
FIG. 23*a* is a cross-sectional view of an alternative arrangement for securing a contact in a housing.

FIG. 23 shows another embodiment of plug connector 290. In this embodiment, the housing 292 has a single front opening 294 in which the contact sections 296 of the plug contacts are disposed. The housing also includes a plurality of openings 298 in the top wall of the housing. As shown in FIG. 23*a*, the bridging element 218 and locating lug 234 engage the top surface 301 of the contact receiving cavity and the bottom surface 295 of the cavity in an interference fit. The arm 228 deflects downwardly as the contact is inserted into the housing and the arm engages portion 303. When the arm 228 clears portion 303, the arm resiles upwardly to locate stop surface 230 adjacent surface 299, thereby locking the contact against retraction. The openings 298 are positioned above the latching arms 228 (FIG. 18), to allow the arm 228 to be moved from a retention position and the contacts to be withdrawn from the housing. This can be accomplished by insertion of a suitable tool (not shown)

through opening 298. Openings 298 can also provide air flow passages for enhancing heat dissipation.

Figure 24:
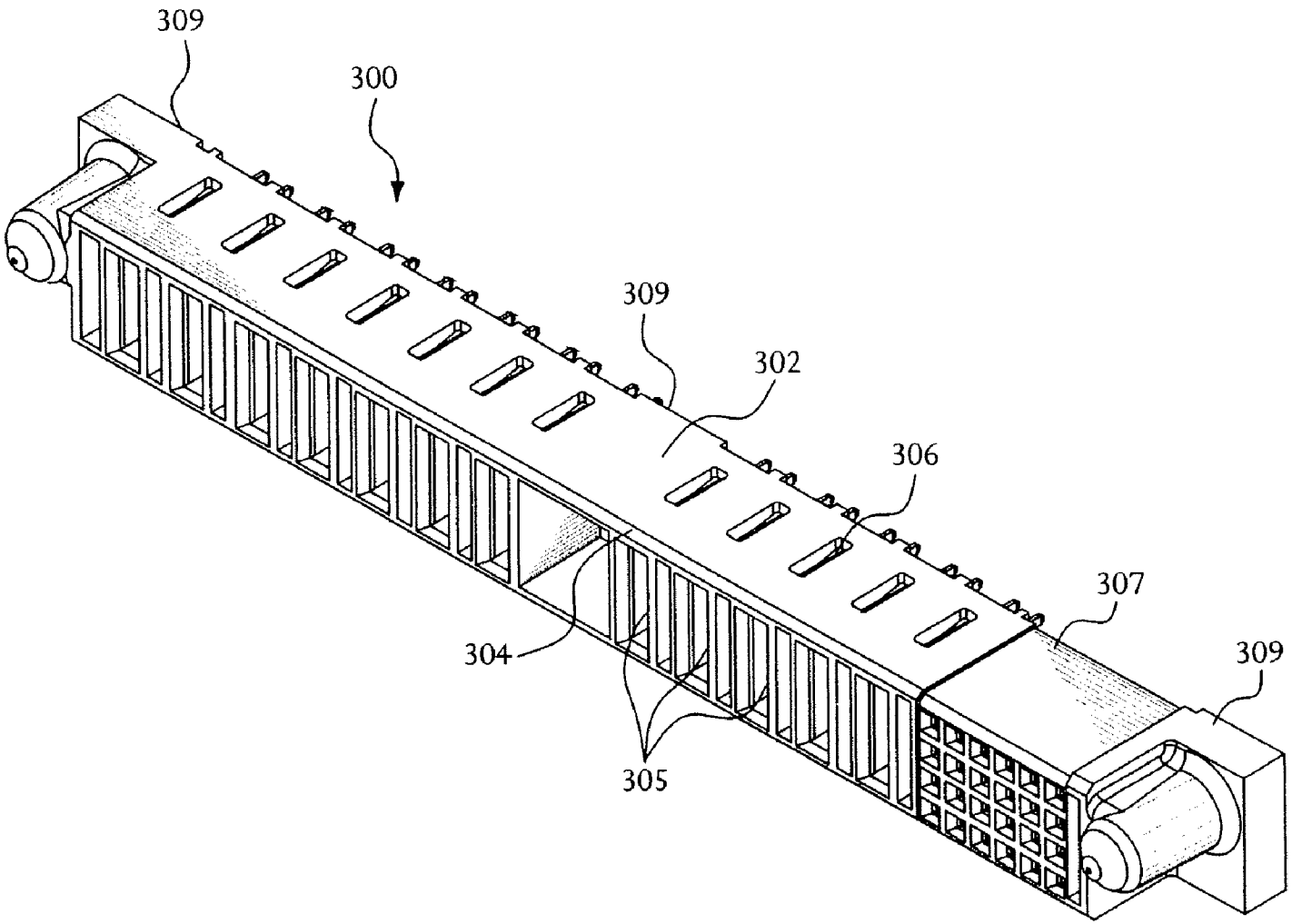
FIG. 24 is a front perspective view of a receptacle connector adapted to mate with the plug connector with FIG. 23.

FIG. 24 illustrates a receptacle connector 300 adapted to mate with plug connector 290. The receptacle connector 230 employs a housing 302 having a continuous front face 304, rather than a plurality of silos as in previous embodiments. The entire front face 304 of the connector 300 is received in opening 294, with the contact sections 296 inserted into openings 305 of face 304. Openings 306 in the top wall of the housing allow access to the latching arms of the receptacle contacts (not shown) as described in the previous embodiment.

Figure 25:
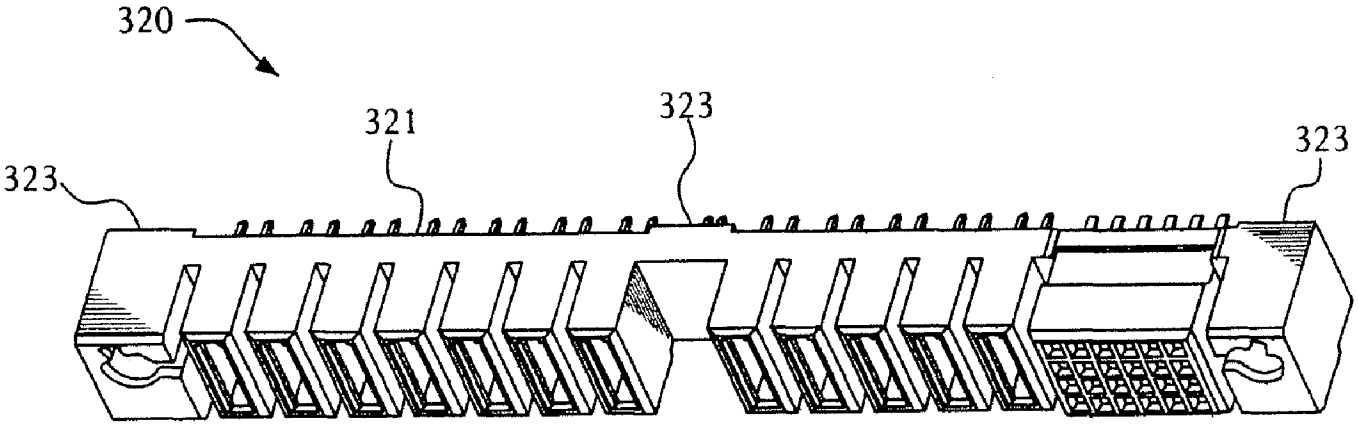
FIG. 25 is a front elevational view of another embodiment of receptacle connector.
Figure 26:
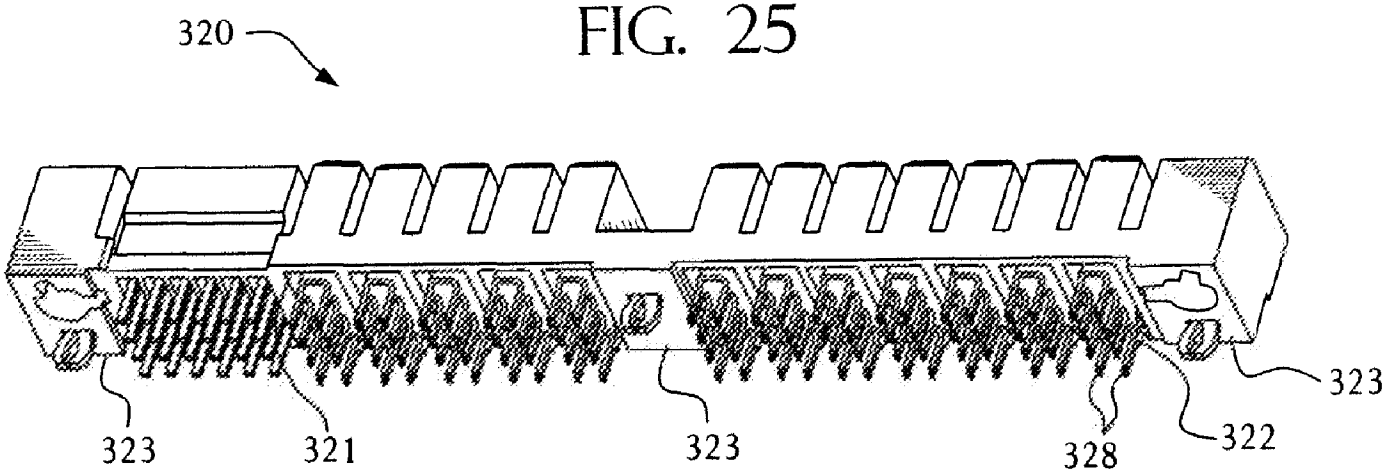
FIG. 26 is a bottom respective view of the connector shown in FIG. 25.

The embodiment of FIG. 24 and also the embodiment of FIGS. 25 and 26 are meant for use in a vertical configuration, as opposed to a right angle configuration. The housing 302 of connector 300 (FIG. 24) has a bottom side 307. Preferably, a plurality of standoff surfaces 309 form a mounting interface, along which the housing is mounted on a substrate, such as a printed circuit board. Similarly, the housing of connector 320 has a bottom surface 321 with standoffs 323. Appropriate receptacle contacts 322 (FIG. 7) are inserted into the housings of connectors 300 and 320 from the bottom sides 307 and 321, respectively.

Figure 27:
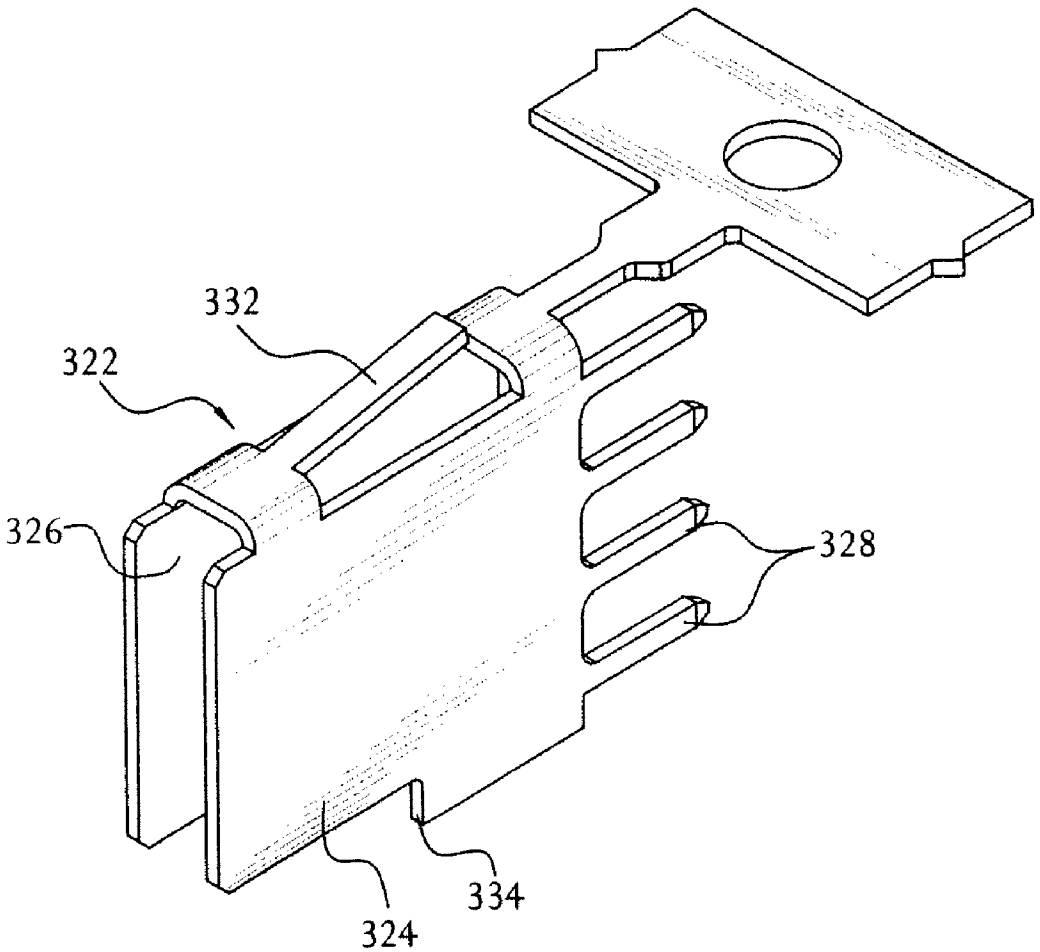
FIG. 27 is an isometric view of a receptacle contact used in the connectors illustrated in the FIGS. 25 and 26.
Figure 28:
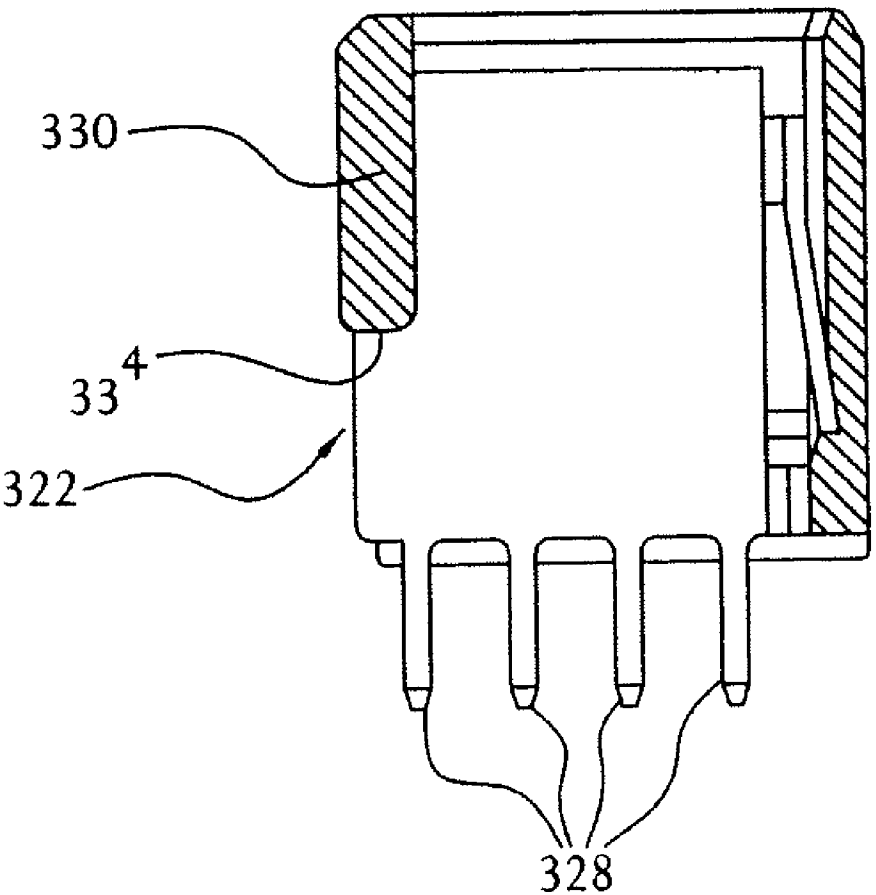
FIG. 28 is a cross-sectional view of a connector as shown in FIG. 25.

FIG. 27 shows a receptacle contact 322 comprising a pair of preferably planar parallel walls 324, 326 that form between them a contact receiving space for receiving plug contacts of the type previously described. This contact has terminals 328 extending from a rear edge of each of the walls. As shown in FIG. 28, the contact 322 is received in housing 330 in a manner similar to that previously described, wherein the resilient latching arm locks the contact against downward (in the sense of FIG. 28) movement, while a locating surface 334 locates the contact in the opposite direction with respect to the housing. The terminals 328 extend beyond the plane of the mounting interface of the connector housing for insertion into through holes in the printed circuit board.

Figure 29:
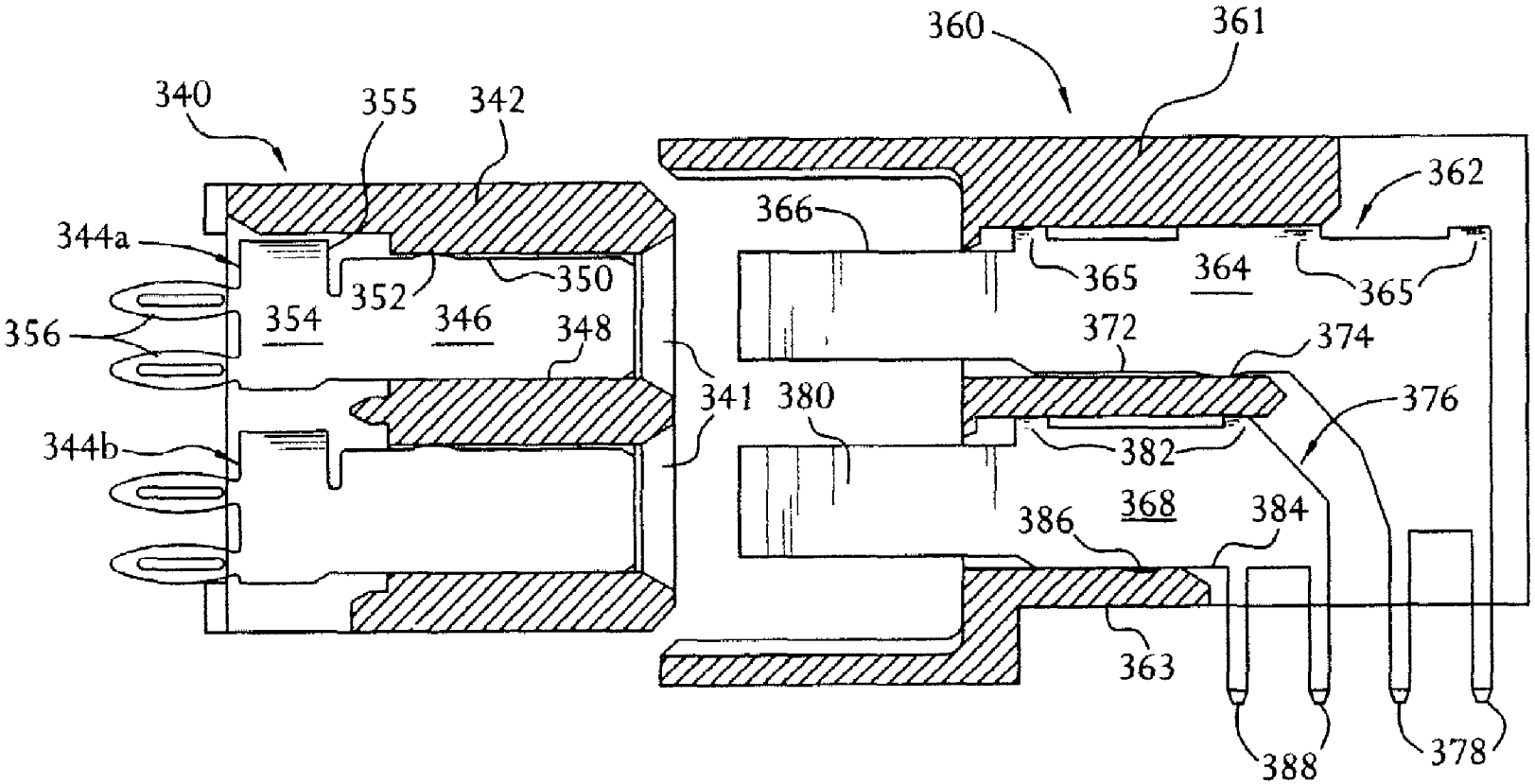
FIG. 29 is a cross-sectional view of an embodiment employing stacked contacts in the plug and receptacle connectors.

FIG. 29 shows an embodiment employing two sets of contacts at each location, in a stacked configuration. The receptacle connector 340 has a housing formed of insulative material. The housing 342 includes a mating interface having a plurality of openings 341. Each of the openings 341 open into cavities in housing, which cavities receive substantially identical receptacle contacts 344*a* and 344*b*. Each of the contacts 344*a* and 344*b* is similar in general construction to the receptacle contacts previously described, there being a pair of such contacts in each cavity, generally aligned along the side walls thereof, to form a gap between generally parallel plate sections 346. The plate sections 346 have two opposed edges 348 and 350, one of which carries a retention feature, such as interference bump 352. The receptacle contact sections 356 are retained in the housing by suitable means, such as an interference fit created by the bump 352. Each contact section 356 includes a generally coplanar wall section 354. The wall sections 354 are joined by a bridge section 355. Suitable terminals, such as press fit terminals 356 extend from an edge of the wall section 354, in the case where the connector 340 is to be used in a vertical configuration.

The mating plug connector 360 includes a molded polymeric body 361 that receives a pair of plug contacts, such as upper plug contact 362 and the lower plug contact 376. These plug contacts are configured generally in the manner previously described, namely, being formed of a pair of spaced wall sections 364 and 368 respectively joined by bridging elements and carrying opposed contact beams 366 and 380 to engage the spaced receptacle plates 346. The plug contact 362 includes a single, relatively long, or several, relatively short, bridging elements 376 that join two opposed plates 364. The bottom edge 372 of each of the plates 364 includes retention structure, such as an interference bump 374. The plug contact 362 is retained in its cavity within housing 361 by an interference fit between the bridging elements 376 and the interference bump 374, although it is contemplated that other retention mechanisms could be utilized. Similarly, lower plug contacts 376 comprise a pair of coplanar wall or panel members 378 joined by one or more bridging elements 382. The lower edge 384 of each wall 378 includes an interference bump 386, that functions to create an interference fit, as previously described. Suitable terminals 368 and 380 extend from each of the panels 364 and 368, beyond the mounting interface 363 of the housing 361, for associating each of the contacts 362 and 376 with electrical tracks on the printed circuit board on which the plug 360 is to be mounted.

Figure 8:
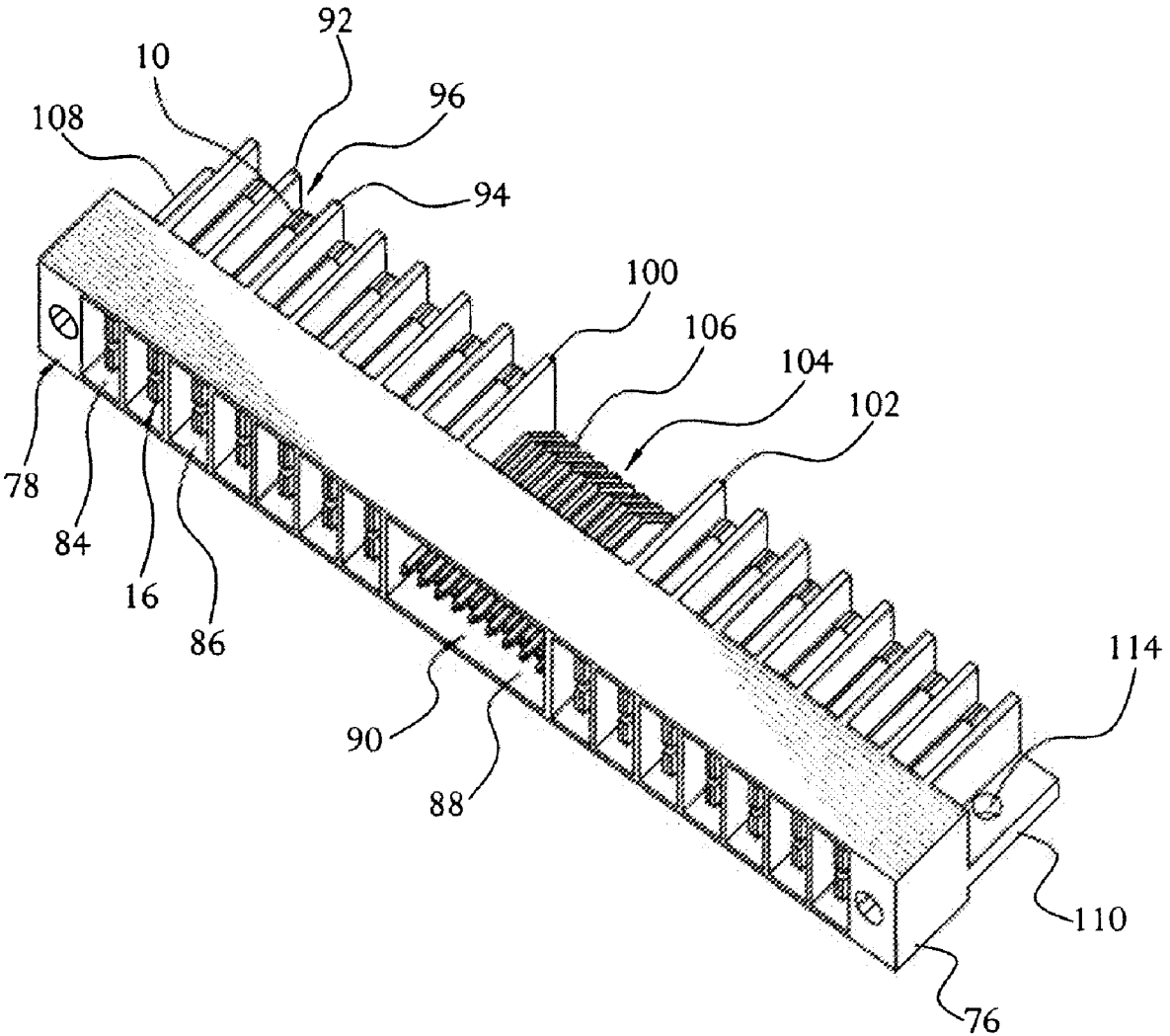
FIG. 8 is a top front perspective view of the plug connector shown in FIG. 5.
Figure 9:
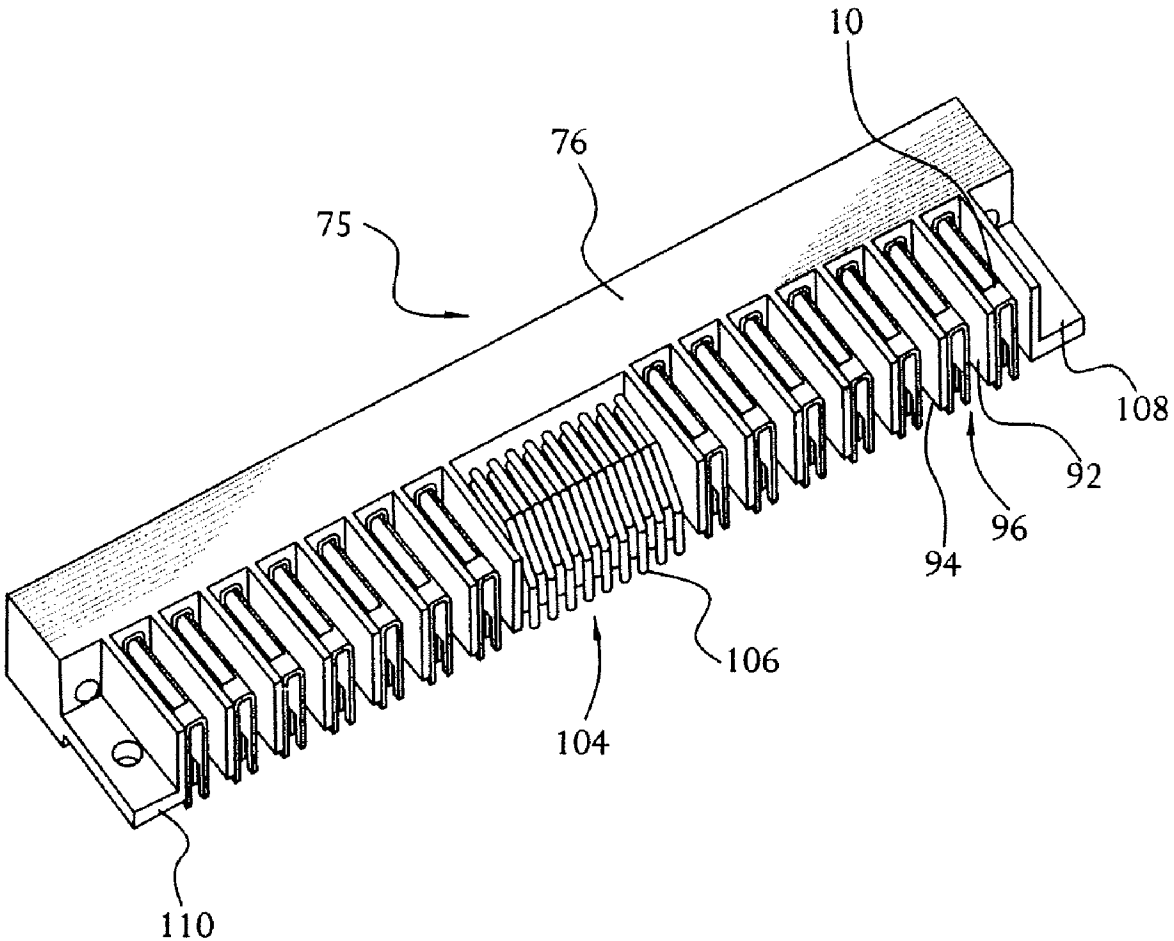
FIG. 9 is a top rear perspective view of the plug connector shown in FIG. 5.
Figure 12:
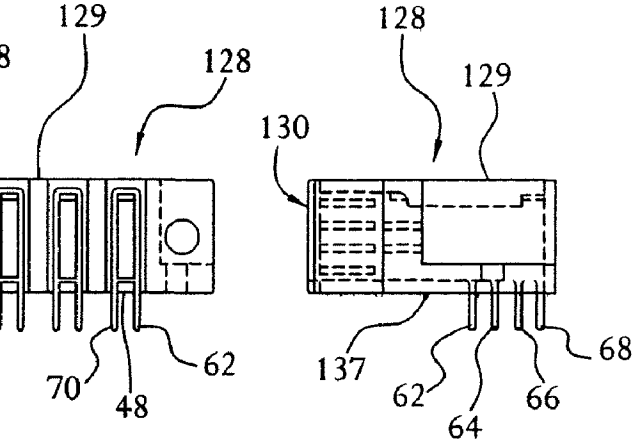
FIG. 12 is an end view of the receptacle connector shown in FIG. 10.
Figure 10:
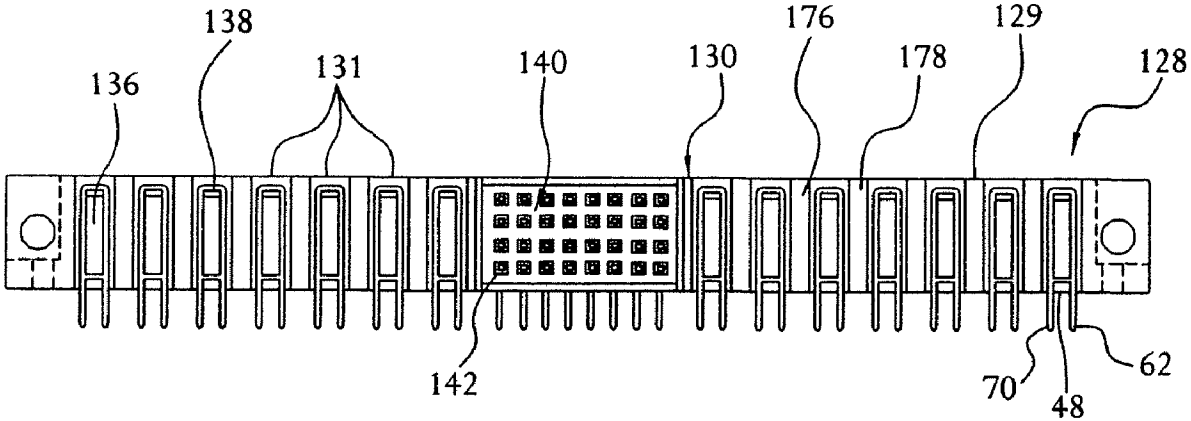
FIG. 10 is a front elevational view of a receptacle connector.
Figure 11:
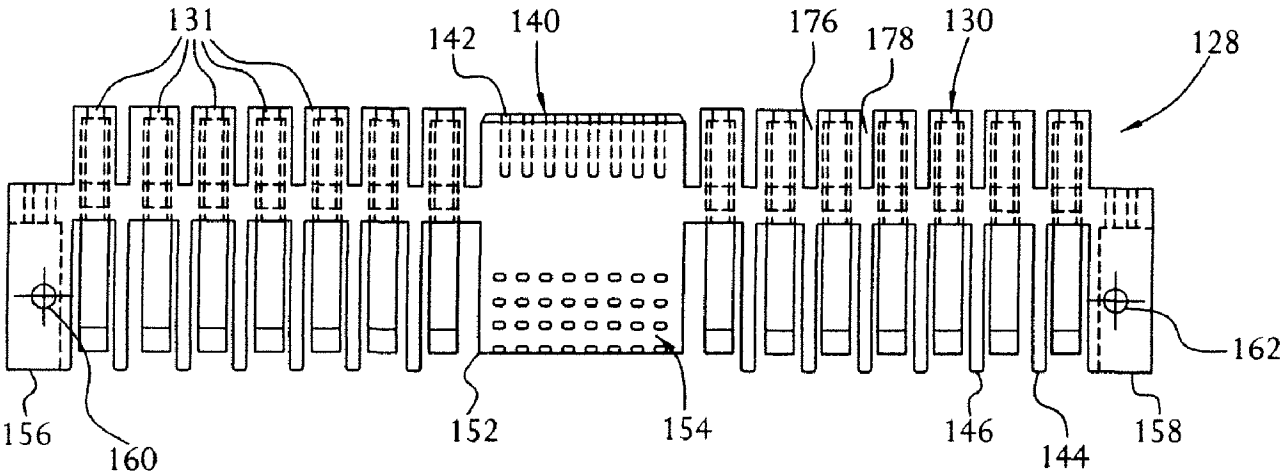
FIG. 11 is a top plan view of the receptacle connector shown in FIG. 10.
Figure 13:
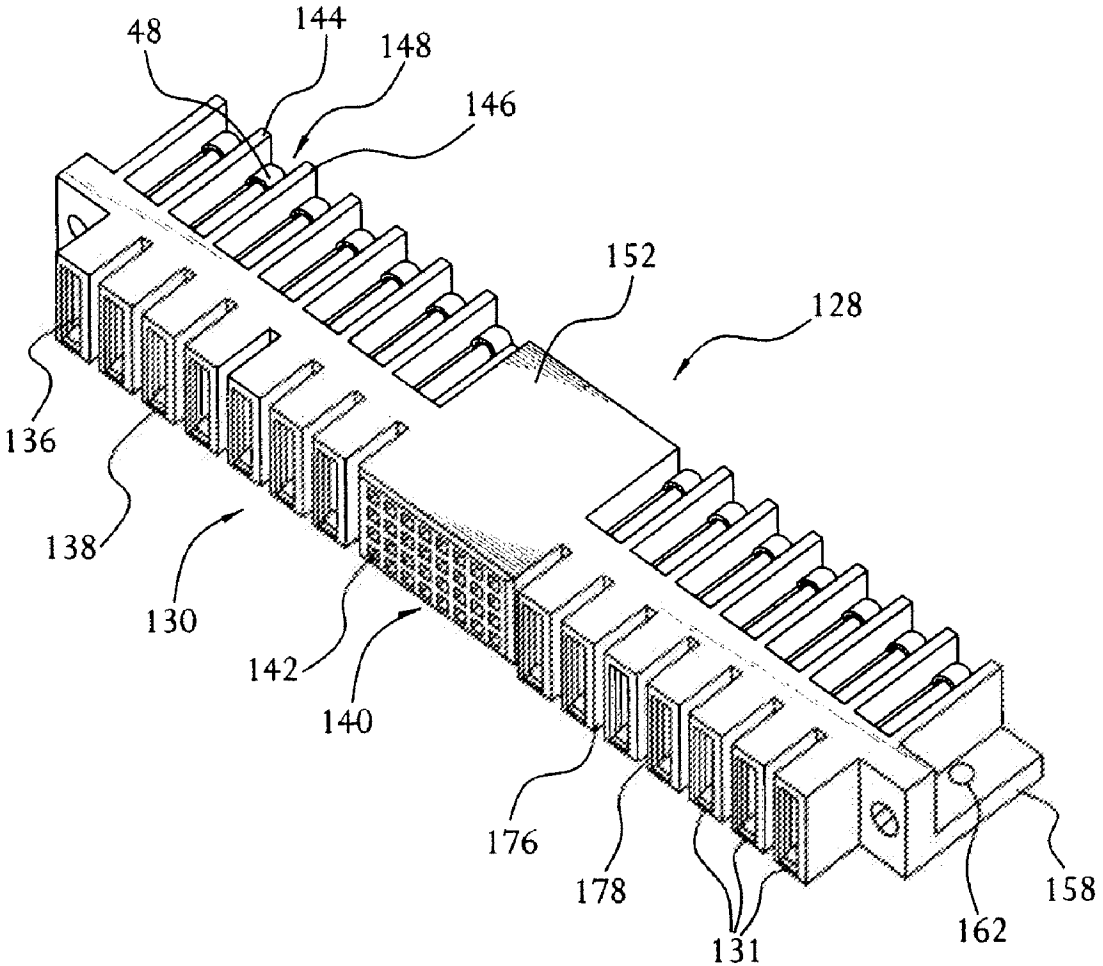
FIG. 13 is a top front respective view of the receptacle connector shown in FIG. 10.
Figure 14:
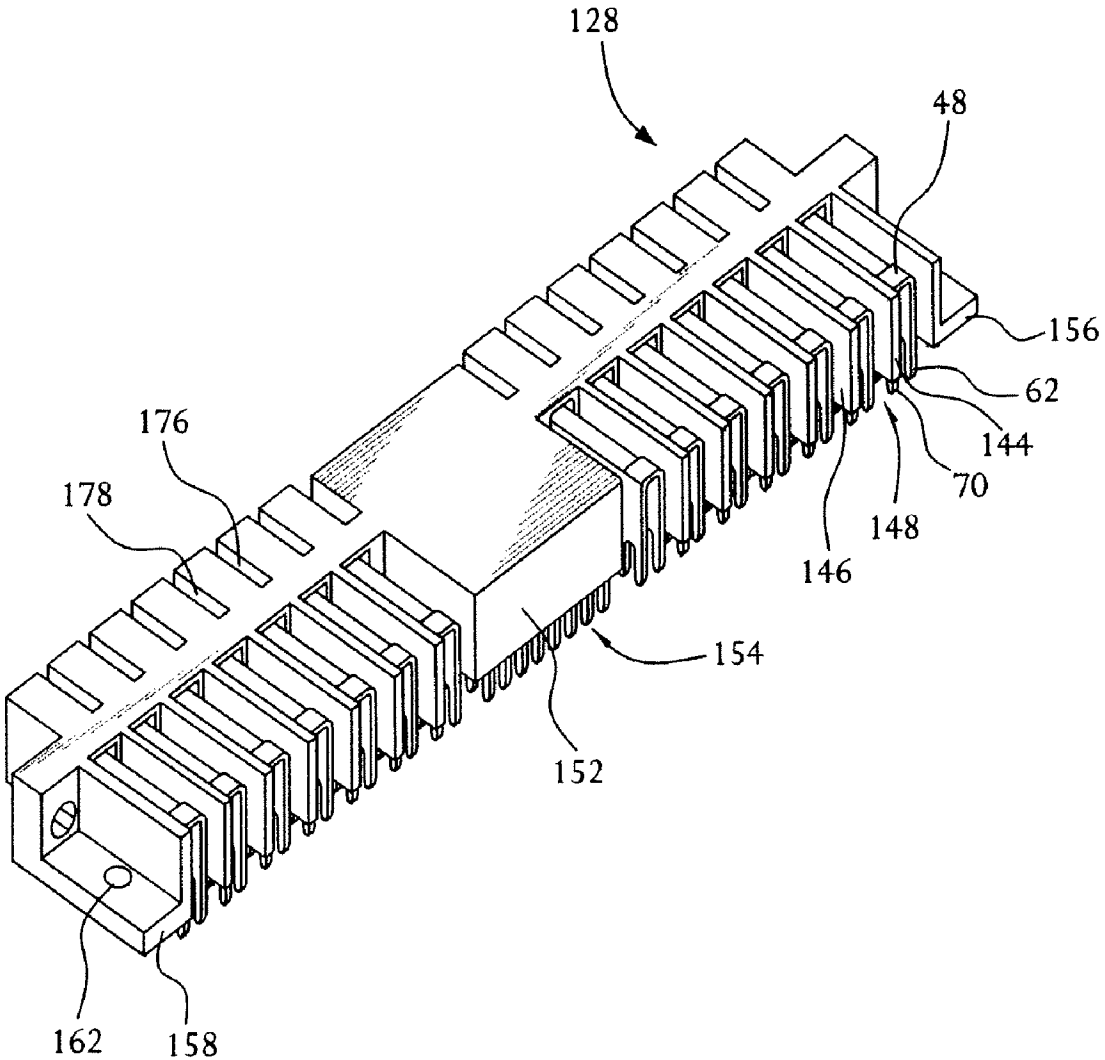
FIG. 14 is a top rear respective view other receptacle connector shown in FIG. 1.

The exemplary receptacle and plug connectors shown and discussed thus far are generally configured to be mated in only a single direction. For example, the right-angle plug connector 75 shown in FIG. 8 is matable with the right-angle receptacle connector 128 shown in FIG. 13 by converging the connectors along a horizontal (lateral) pathway. These connectors, by virtue of their configuration, cannot however be mated along additional directional pathways. Alternative connectors contemplated by the present invention can provide multi-directional mating, as discussed in more detail below.

Figure 30:
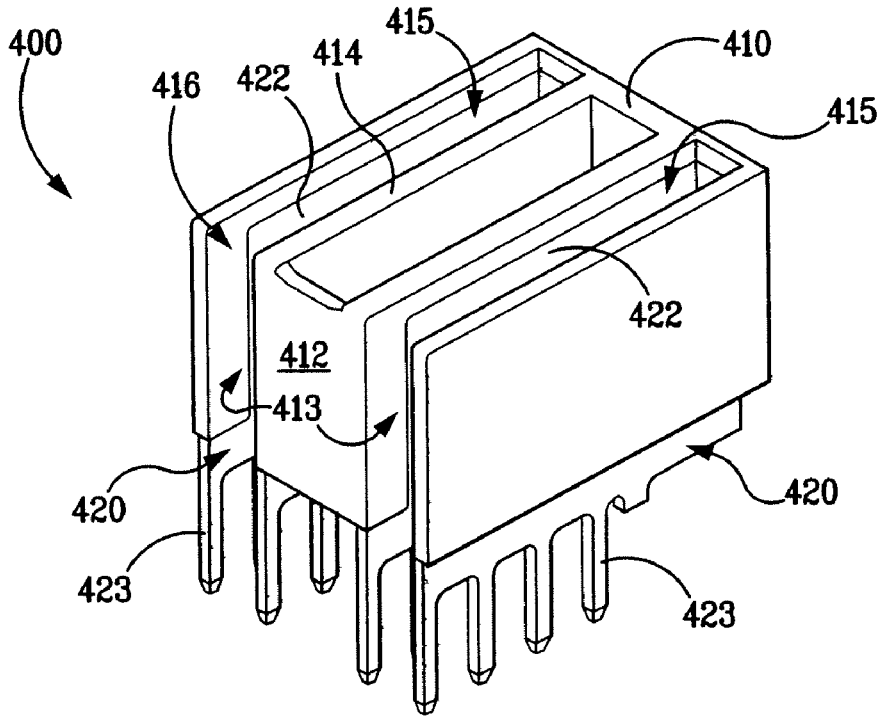
FIG. 30 is a perspective view of an alternative receptacle connector embodiment in accordance with the present invention.
Figure 33:
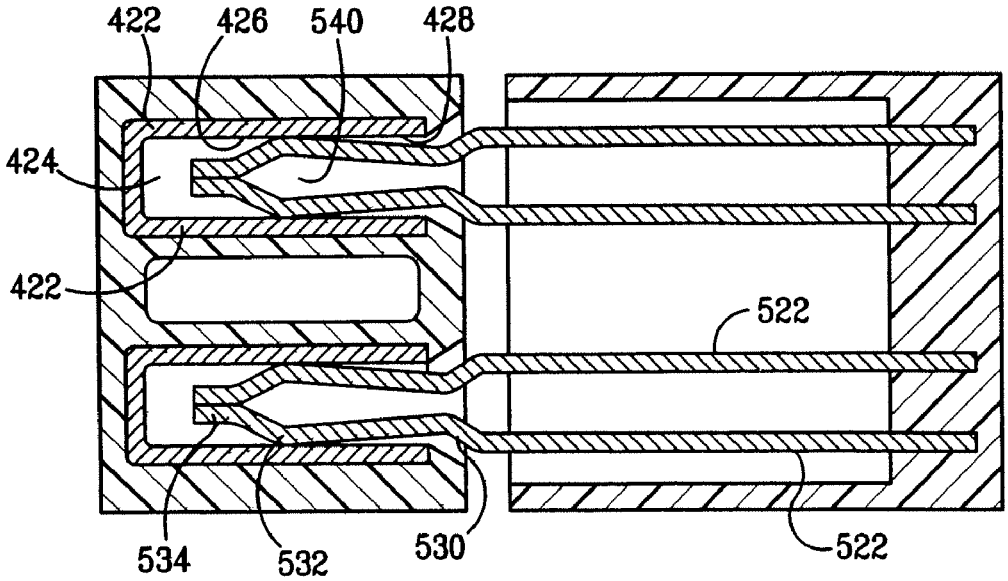
FIG. 33 is a cross-sectional view taken through line XXXIII-XXXIII as shown in FIG. 32.

Referring now to FIGS. 30 and 33, an exemplary receptacle connector 400 is shown that is adapted to receive a plug connector horizontally, vertically, or rotationally. Receptacle connector 400 includes a housing 410 and two receptacle contacts 420. Each of the two receptacle contacts 420 includes a pair of spaced apart side walls 422 and a plug contact receiving space 424 defined therebetween. Side walls 422 each have a dedicated set of terminals 423 for engaging a printed circuit structure, so that current flow is relatively unrestricted (that is, current crowding is limited by current being able to flow from each of the side walls directly to the printed circuit structure through its own set of terminals).

Figure 31:
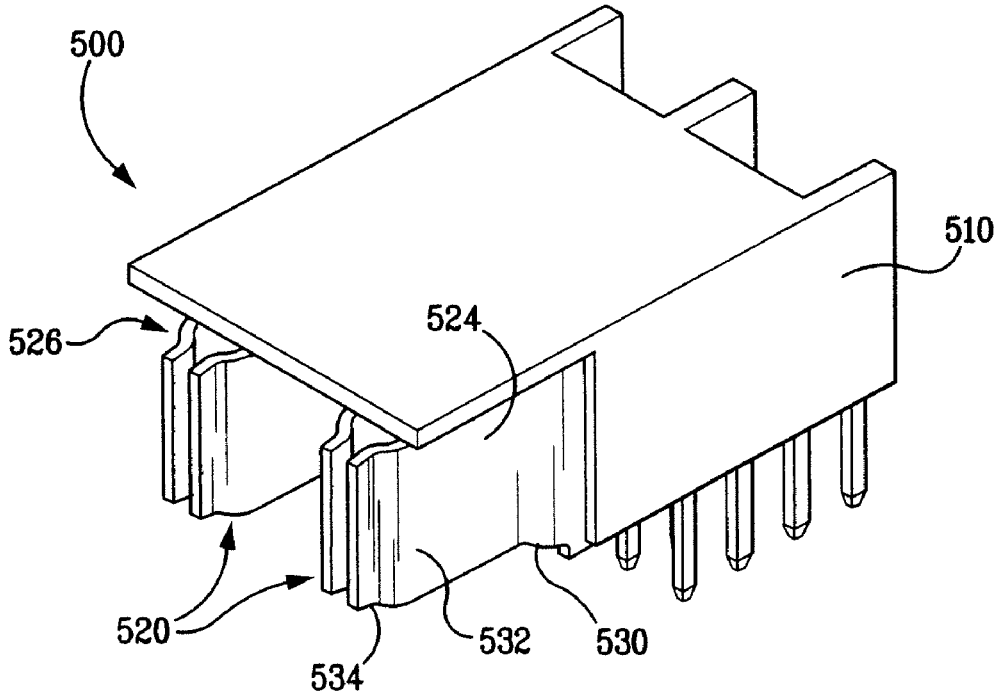
FIG. 31 is a perspective view of a plug connector that is matable with the receptacle connector shown in FIG. 30.

Receptacle connector housing 410 includes a front mating face 412, and a second mating face 414 that is preferably positioned orthogonally to front mating face 412. Mating face 412 includes individual openings 413 that provide access to plug contact receiving spaces 424; mating face 414 includes openings 415. Openings 413 permit horizontal mating, while openings 415 permit vertical mating. The openings may be tapered to improve alignment and initial mating of the connectors. In a preferred embodiment, and as shown in FIG. 30, openings 413 and 415 abut to define continuous openings 416. Such continuous openings allows for rotational connector mating, wherein a plug connector (for example, plug connector 500 shown in FIG. 31) can initially engage the receptacle connector along one directional pathway and then be rotated to a final position.

Figure 32:
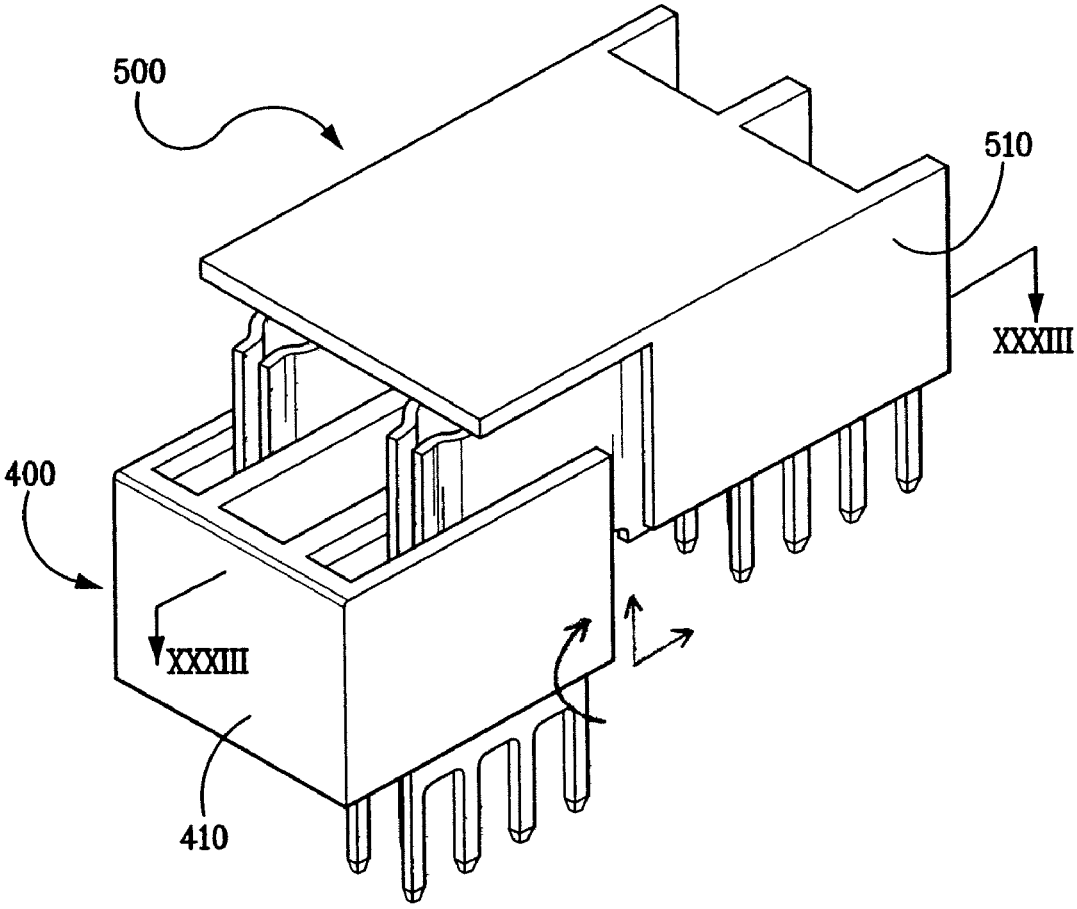
FIG. 32 is a perspective view of the connectors in FIGS. 30 and 31 being mated.

Referring now to FIGS. 32 and 33, plug connector 500 is shown being vertically mated with receptacle connector 400. Plug connector 500 includes a housing 510 and two plug contacts 520. In a preferred embodiment, each of plug contacts 520 comprises spaced apart side walls 522 and a pair of cantilevered beams 524 that define a front projection 526. The cantilevered beams have an inwardly converging proximal section 530, an outwardly-directed arcuate section 532, and a distal section 534. Alternate plug contact designs can include a single side wall and a front projection that is different than that shown in FIG. 32. Plug connector 500 is illustrated having an overhanging shroud; however, this shroud is an optional feature.

With the vertical mating direction shown in FIGS. 32 and 33, the outwardly-directed arcuate sections 532 result in the cantilevered beams at least initially only engaging a second region 426 that is distal to a front region 428 of an adjacent receptacle contact side wall 422. Cantilevered beams 524 resiliently deflect inwardly toward the center plane of plug contact 520. This deflection may result in the cantilevered beams engaging front regions 428 of the receptacle contact side walls as well. Distal sections 534 come together upon complete mating, but a medial air gap 540 is maintained between some portions of the opposed cantilevered beams to facilitate heat dissipation. It should be noted that the receptacle and plug connectors shown in FIGS. 30-33 are shown having two power contacts within the respective connector housings, but a greater or fewer number of contacts can be included, as well as the addition of signal contacts.

It should be noted that plug connector 500 can employ plug contacts having tapered cantilevered beams. That is, each of the opposed cantilevered beams can be tapered in a direction going from the beams proximate section to their distal section. FIGS. 17 and 18 illustrate such a configuration, and the corresponding written description refers to the contact features (e.g., proximate and distal sections) being similar to those described in connection with the plug contact shown in FIG. 1. This tapered configuration provides more surface area in the proximate section as compared with the surface area in the distal section. The taper can help in the mating of plug connectors with receptacle connectors by providing some ramping to assist in the engagement of the respective contacts housed within the connectors.

The previously described receptacle and plug contacts may be plated or otherwise coated with corrosion resistant materials. Also, the plug contact beams may be bowed slightly in the transverse direction to enhance engagement with the contact receiving surfaces of the receptacle contacts.

The "dual-mass" construction of both receptacle and blade contacts, employing opposing, relatively thin walls, allows for greater heat dissipation as compared with prior "singular-mass" designs. In comparison with "singular mass" connectors of similar size and power handling capabilities, the "dual mass" connectors, as disclosed have approximately two times the surface area. The enhanced current flow and heat dissipation properties result from the contacts having greater surface area available for convection heat flow, especially through the center of the mated contacts. Because the plug contacts have an open configuration, heat loss by convection can occur from interior surfaces by passage of air in the gap between these surfaces.

The contacts also contain outwardly directed, mutually opposing receptacle beams and dual, peripherally located, mating blades, in a configuration which can allow for flexibility in modifying contact normal forces by adjustment the contact connector geometry. This can be accomplished by modifying the bridging elements to change bend radius, angle, or separation of the walls of the contacts. Such modifications cannot be accomplished with conventional singular-mass beam/blade configurations wherein the opposing receptacle contacts are inwardly directed, and the mating blade is located in the center of said beams.

Such dual, opposing, planar contact construction also allows for easier inclusion of additional printed circuit board attachment terminals with more separation between terminals, compared to an equivalent "singular-mass" bulk designs. The use of relatively larger plates in the plug and receptacle contacts gives this opportunity for providing a plurality of circuit board terminals on each contact part. These lessens constriction of current flow to the printed circuit board, thereby lowering resistance and lessening heat generation.

The use of a compliant plug mating section allows the receptacle contacts to be placed in a protected position within the molded polymeric housing for safety purposes. This feature is of further benefit because it allows minimization of amount of polymeric material used in making the housing. This lowers material costs and enhances heat dissipation. Also, by retaining the contacts in the housing in the manner suggested, thick wall structures can be avoided and thin, fin like structures can be utilized, all of which enhances heat dissipation from the connectors. Additionally, first-make, last break functionality can be incorporated easily into disclosed connector system by modifying the length of the mating portion of the plug contacts or by changing the length of the plug-receiving portion of the receptacle contacts.

The arch connection structure between opposing rectangular contact sections also allows for attachment of retention means, such as a resilient arm structure as shown in one of the current embodiments, in a manner that does not limit current flow or hinder contact heat dissipation capability.

It will also be appreciated that the plug and receptacle contacts may be manufactured from closely similar or identical blanks thereby minimizing tooling requirements. Further, the plug or receptacle connectors can easily be associated with cables, by means of paddle boards.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed:

1. Matable electrical connectors, comprising:

a) a plug connector comprising:

i) a plug housing; and ii) a plug contact at least partially disposed within the plug housing, the plug contact including a projection for engaging a receptacle contact, the projection having a proximal section and an outwardly directed arcuate section, opposed cantilevered beams capable of being pressed against to each other, and a plurality of terminals each extending perpendicular to a respective one of the cantilevered beams; and b) a receptacle connector comprising:

i) a receptacle housing including a front mating face; and ii) a receptacle contact disposed within the receptacle housing, the receptacle contact including a pair of spaced apart side walls, a plurality of terminals for engaging a printed circuit structure and each extending perpendicular to a respective one of the side walls, and a plug contact receiving space extending between the side walls for receiving the plug contact projection, each of the pair of spaced apart side walls having a front region proximate the front mating face and a second region that is distal the front region;

wherein the receptacle housing includes an opening that is in fluid communication with the plug contact receiving space and that permits mating of the plug connector with the receptacle connector completely in a first direction and, alternatively, completely in a second direction substantially perpendicular to the first direction, and wherein in the first direction of mating, the plug contact projection, via the outwardly-directed arcuate section, initially substantially only engages the second region of the side walls.

2. The matable electrical connectors of claim 1, wherein a medial air gap exists between portions of the opposed cantilevered beams when inserted into the plug contact receiving space of the receptacle contact.

3. The matable electrical connectors of claim 1, wherein the plug contact further includes a pair of spaced apart sidewalls from which the projection extends.

4. The matable electrical connectors of claim 1, wherein the receptacle housing opening extends along at least portions of both the front mating face and a face that is positioned substantially orthogonal to the front mating face.

5. Matable electrical connectors, comprising:

a) a plug connector comprising:

i) a plug housing; and ii) a plug contact at least partially disposed within the plug housing, the plug contact including a pair of spaced apart side walls and cantilevered beams each extending from an edge of each of the pair of spaced apart side walls, and a plurality of terminals for engaging a printed circuit structure and extending perpendicular to a respective one of the side walls, wherein each of the cantilevered beams includes a proximal section and an arcuate section extending from the proximal section and being capable of being pressed against the arcuate section of the other cantilevered beam; and b) a receptacle connector comprising:

i) a receptacle housing including a first mating face having a first opening therein, and a second mating face positioned substantially orthogonal to the first mating face and having a second opening therein; and ii) a receptacle contact disposed within the receptacle housing, the receptacle contact including a second pair of spaced apart side walls and a plug contact receiving space defined therebetween, the plug contact receiving space being completely accessible to the plug contact through the first mating face alone, the second mating face alone, and both of the first mating face and the second mating face;

whereupon mating the plug connector with the receptacle connector, each of the cantilevered beams is resiliently deflected inwardly by an adjacent one of the second pair of spaced apart side walls.

6. The matable electrical connectors of claim 5, wherein the first and second openings are defined by a single, continuous opening.

7. The matable electrical connectors of claim 5, wherein each of the cantilevered beams further includes a distal section extending from the arcuate section, and wherein the distal sections come together when the plug connector is mated with the receptacle connector.

8. The matable electrical connectors of claim 5, wherein the cantilevered beams oppose one another and a medial air gap exists between portions of the cantilevered beams when inserted into the plug contact receiving space of the receptacle contact.

9. The matable electrical connectors of claim 5, wherein the first opening and the second opening adjoin to form a continuous opening and the plug connector is matable with the receptacle connector horizontally and vertically.

10. The matable electrical connectors of claim 5, wherein the cantilevered beams further include a distal section, and wherein the cantilevered beams are tapered from the proximal section to the distal section.

* * * * *